US009775438B1

(12) United States Patent
Schulenberg

(10) Patent No.: US 9,775,438 B1
(45) Date of Patent: Oct. 3, 2017

(54) HEATED AND RECREATIONAL CHAIRS

(71) Applicant: Mark D. Schulenberg, Eugene, OR (US)

(72) Inventor: Mark D. Schulenberg, Eugene, OR (US)

( * ) Notice: Subject to any disclaimer, the term of this patent is extended or adjusted under 35 U.S.C. 154(b) by 244 days.

(21) Appl. No.: 14/295,763

(22) Filed: Jun. 4, 2014

Related U.S. Application Data

(62) Division of application No. 13/182,514, filed on Jul. 14, 2011, now abandoned.

(60) Provisional application No. 61/365,595, filed on Jul. 19, 2010, provisional application No. 61/365,111, filed on Jul. 16, 2010.

(51) Int. Cl.

| | |
|---|---|
| ***A47C 4/28*** | (2006.01) |
| ***A47C 7/70*** | (2006.01) |
| ***A47C 7/74*** | (2006.01) |
| ***A47B 3/14*** | (2006.01) |

(52) U.S. Cl.
CPC ..... *A47C 4/283* (2013.01); *A47B 3/14* (2013.01); *A47C 7/70* (2013.01); *A47C 7/748* (2013.01)

(58) Field of Classification Search
CPC ..... A47C 4/283; A47C 7/70; A47C 7/748; A47C 3/14
USPC ..... 297/248, 45, 180.12, 173
See application file for complete search history.

(56) References Cited

U.S. PATENT DOCUMENTS

| | | | | |
|---|---|---|---|---|
| 3,621,192 | A | 11/1971 | Pohler | |
| 5,570,928 | A * | 11/1996 | Staunton | A47C 4/283 297/232 |
| 5,865,124 | A * | 2/1999 | Wroe | A47C 7/70 108/157.11 |
| 5,873,624 | A | 2/1999 | Simpson | |
| 6,364,411 | B1 | 4/2002 | Zheng | |
| 6,375,258 | B1 | 4/2002 | Fang | |
| 6,450,161 | B1 * | 9/2002 | Izumi | F24C 1/16 126/9 R |
| 6,629,722 | B1 | 10/2003 | Tang | |
| D490,251 | S | 5/2004 | Lin | |
| D522,263 | S | 6/2006 | Hart | |
| 7,845,720 | B2 | 12/2010 | Randall | |
| 7,866,743 | B1 | 1/2011 | Russell et al. | |
| 2003/0127885 | A1 | 7/2003 | Tang | |
| 2004/0075311 | A1 | 4/2004 | Linder | |
| 2007/0152479 | A1 | 7/2007 | Howman et al. | |
| 2009/0072594 | A1 | 3/2009 | Korytowski | |
| 2010/0032998 | A1 | 2/2010 | Eckman et al. | |
| 2010/0187866 | A1 | 7/2010 | Chen | |
| 2010/0283295 | A1 | 11/2010 | Smith et al. | |

* cited by examiner

*Primary Examiner* — Milton Nelson, Jr.
(74) *Attorney, Agent, or Firm* — Jerry Haynes Law

(57) ABSTRACT

A double heated recreational chair includes a pair of chair frames and a table top tray pivotally and swivelly carried by the chair frame. The chair frame is selectively deployable in a folded, collapsed configuration in which the table top tray is deployed in a folded position adjacent to the chair frame. The chair frame is selectively deployable in an extended, functional configuration in which the table top tray is supported on the chair frame in a generally horizontal position.

6 Claims, 30 Drawing Sheets

HEATED AND RECREATIONAL CHAIRS

CROSS-REFERENCE TO RELATED APPLICATIONS

This application is divisional application of U.S. application Ser. No. 13/182,514, filed Jul. 14, 2011 and entitled "HEATED AND RECREATIONAL CHAIRS", which application claims the benefit of U.S. provisional application No. 61/365,111, filed Jul. 16, 2010 and entitled "HEATED CHAIR", and U.S. provisional application No. 61/365,595, filed Jul. 19, 2010 and entitled "RECREATIONAL CHAIR", all of which divisional application and provisional applications are incorporated by reference herein in their entirety.

FIELD OF THE INVENTION

The disclosure generally relates to recreational chairs. More specifically, the disclosure relates to collapsible and heated recreational chairs having deployable dinner and beverage trays for seated occupants.

BACKGROUND OF THE INVENTION

Recreational or "Director's" chairs are commonly used for outdoor activities such as sporting events, camping, fishing, and "tailgating". It would be desirable if such chairs could include a place where plates, cups, utensils, and napkins can be stored. Other applications of such chairs include use as a work surface for laptop computers, by score keepers and statisticians at sporting events and by senior citizens accommodating their independence at assisted living facilities, for example. There are chairs which have small limited usage trays but a need exists for a recreational chair that utilizes a full sized tray that can be effortlessly positioned into or out of place and then collapsed for ease of transport and storage when not in use.

There is a need for a chair which is designed specifically for the enjoyments of tailgating and the great outdoors as well as providing a stable work surface. A need also exists for a heated recreational chair which utilizes a tray that can be effortlessly positioned into or out of place and then collapsible for ease of storage when not in use.

SUMMARY OF THE INVENTION

The disclosure is generally directed to a recreational chair which utilizes a tray that can be effortlessly positioned into or out of place and then collapsible for ease of storage when not in use. An illustrative embodiment of the recreational chair includes a chair frame and a table top tray pivotally and swivelly carried by the chair frame. The chair frame is selectively deployable in a folded, collapsed configuration in which the table top tray is deployed in a folded position adjacent to the chair frame. The chair frame is selectively deployable in an extended, functional configuration in which the table top tray is supported on the chair frame in a generally horizontal position.

In some embodiments, the heated recreational chair may include at least one chair frame including a pair of spaced-apart side frame portions and a pair of backrest frames and a pair of seat frame members carried by the side frame portions, respectively; a seat carried by the seat frame members; a backrest carried by the backrest frames; and a heating mechanism including at least one of a backrest heating unit carried by the backrest and a seat heating unit carried by the seat, a battery pack electrically connected to the at least one of a backrest heating unit and a seat heating unit and a control module electrically connected to the battery pack and the at least one of a backrest heating unit and a seat heating unit. The chair frame is selectively deployable in a folded, collapsed configuration and an extended, functional configuration.

In some embodiments, a heated stadium chair includes a chair frame including a seat frame portion and a backrest frame portion pivotally carried by the seat frame portion; a seat carried by the seat frame portion; a backrest carried by the backrest frame portion; and a heating mechanism including at least one of a backrest heating unit carried by the backrest and a seat heating unit carried by the seat and a controller/power source electrically connected to the at least one of a backrest heating unit and a seat heating unit. The chair frame is selectively deployable in a folded, collapsed configuration and an extended, functional configuration.

BRIEF DESCRIPTION OF THE DRAWINGS

The disclosure will now be made, by way of example, with reference to the accompanying drawings, in which.

DETAILED DESCRIPTION

Figure 4:
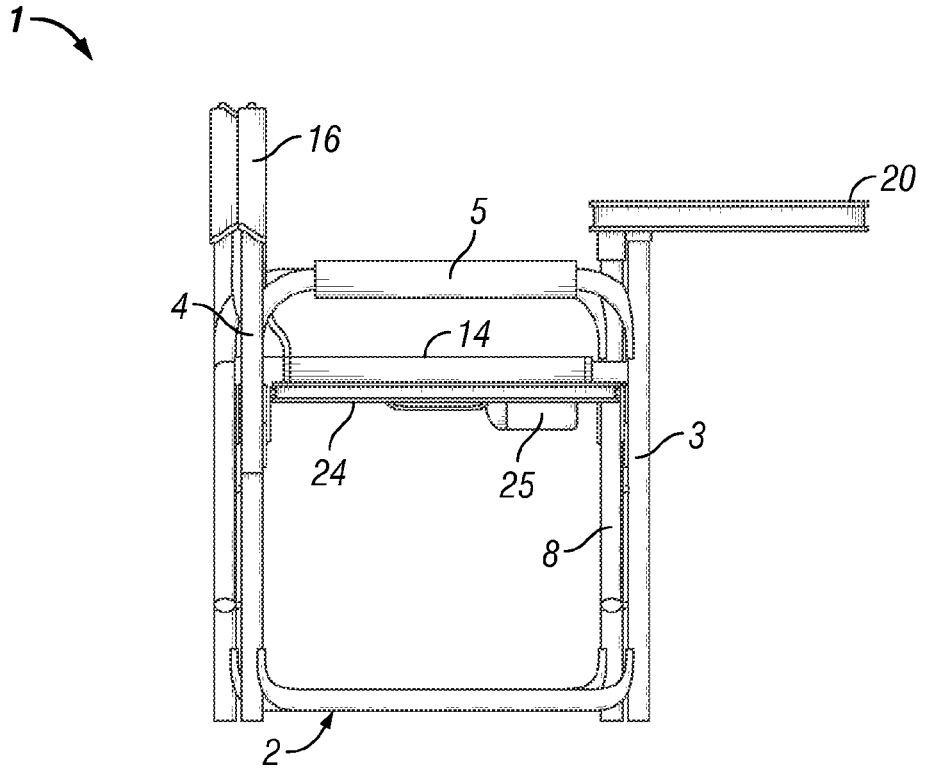
FIG. 4 is a right side view of the chair of FIG. 1.
Figure 5:
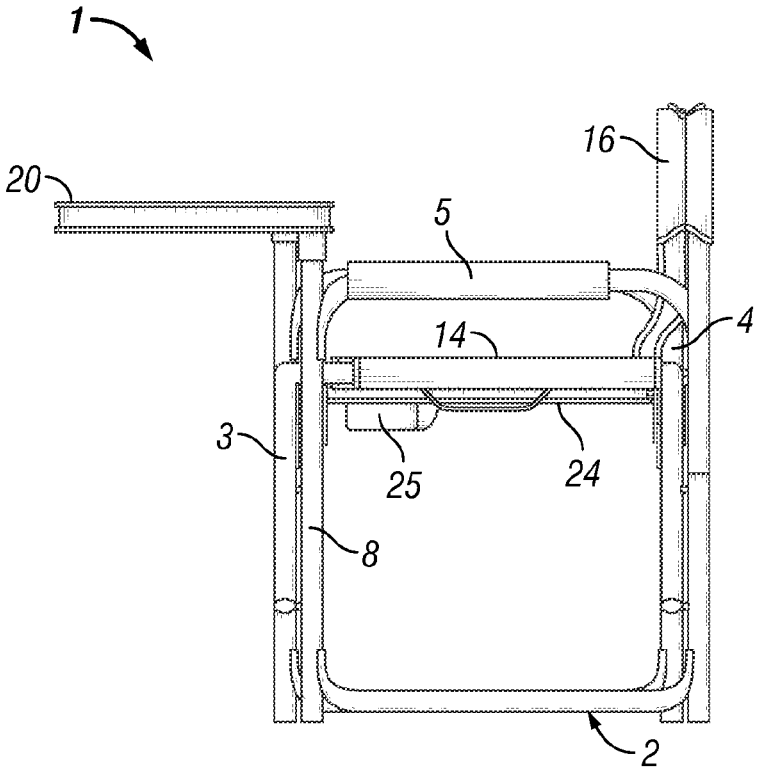
FIG. 5 is left side view of the chair of FIG. 1.
Figure 6:
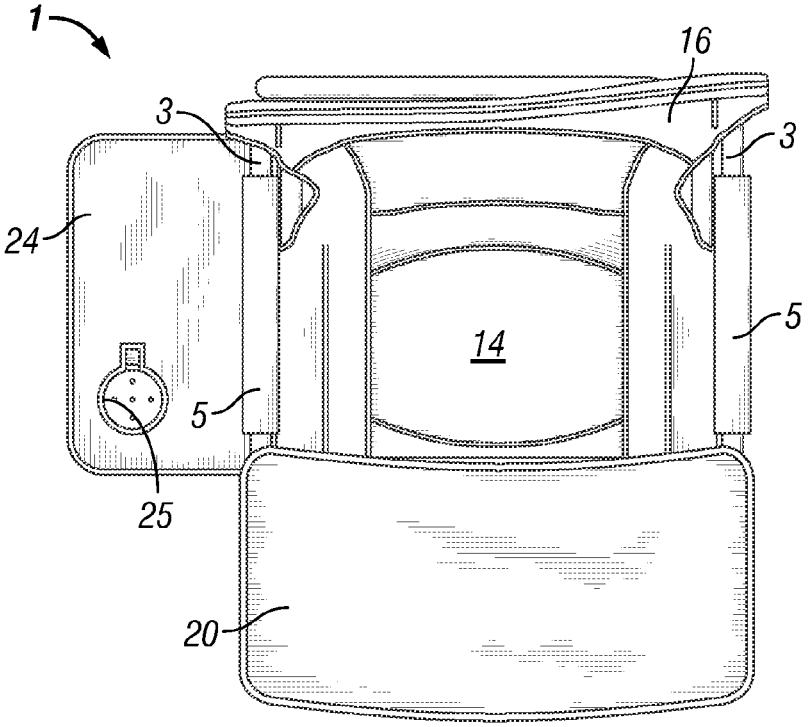
FIG. 6 is a top view of the chair of FIG. 1.
Figure 7:
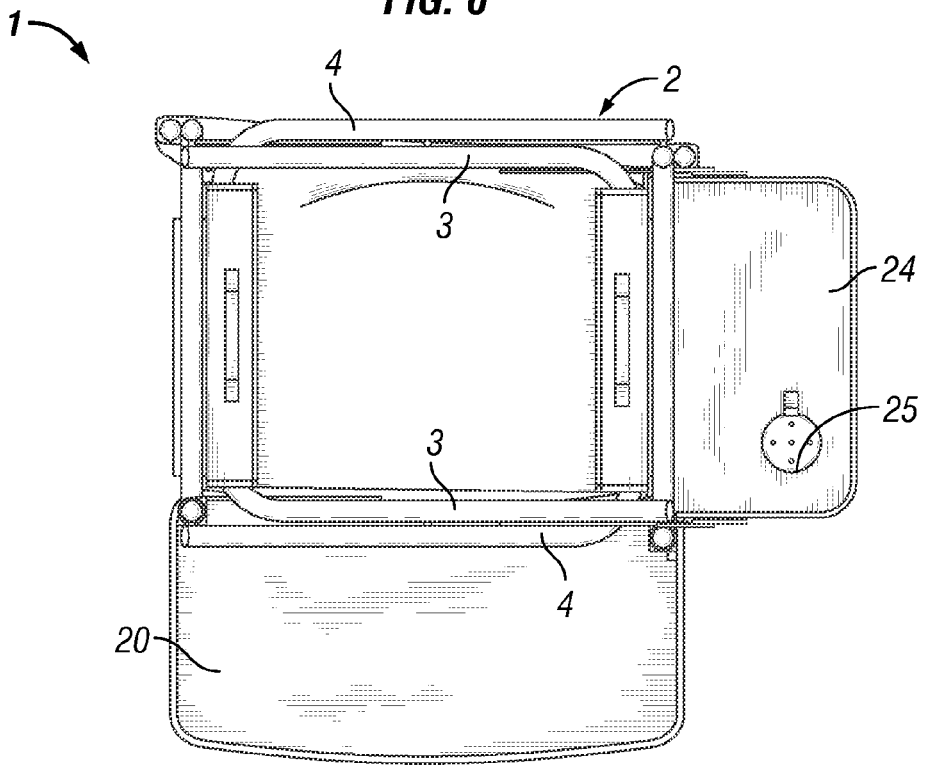
FIG. 7 is a bottom view of the chair of FIG. 1.

Referring initially to FIGS. 1-16 of the drawings, an illustrative embodiment of the recreational chair is generally indicated by reference numeral 1. The recreational chair 1 includes a chair frame 2 which may include a pair of spaced-apart side frame portions 3. As illustrated in FIGS. 4 and 5, each of the side frame portions 3 of the chair frame 2 may be generally rectangular in shape. Backrest frames 4 may extend from the respective side frame portions 3. A backrest 16 which may be a flexible fabric material may extend between the backrest frames 4. An armrest 5 may be provided on each side frame portion 3.

A pair of seat frame members 8 may be pivotally attached to the respective side frame portions 3 at a pair of pivot points 6. Each seat frame member 8 may have a generally U-shaped configuration. The seat frame members 8 may be pivotally attached to each other at a pivot point 9. A seat 14, which may be a flexible fabric material, may extend between the seat frame members 8. Seat frame stabilizing arms 10 may be pivotally connected to each seat frame member 8 and to the side frame portion 3 on the corresponding side of the chair frame 2 for stabilizing purposes. Accordingly, it will be appreciated by those skilled in the art that the chair frame 2 can be selectively deployed between the extended, functional position illustrated in FIGS. 1-8 and the folded or collapsed position illustrated in FIGS. 9A and 9B for purposes which will be hereinafter described.

Figure 1:
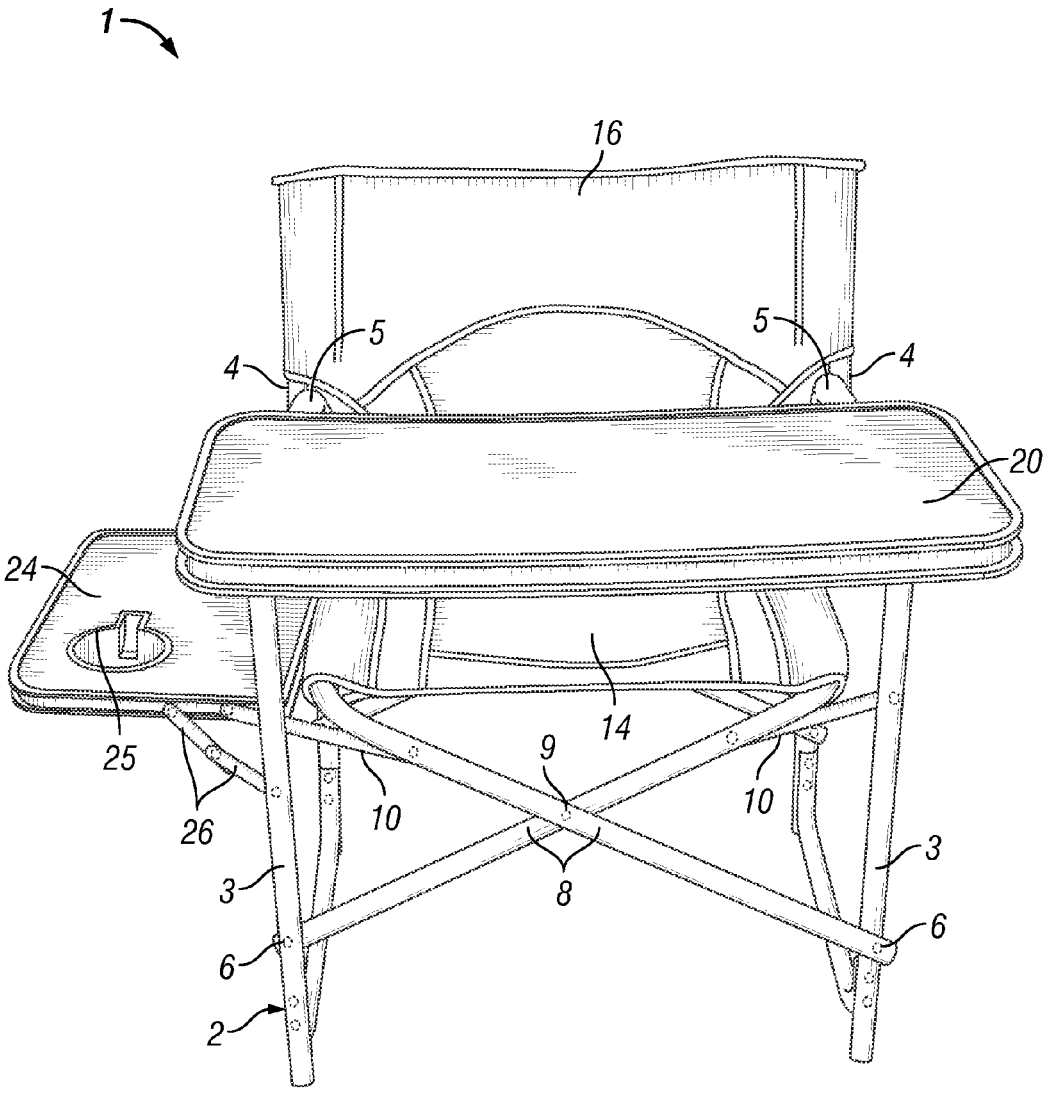
FIG. 1 is a perspective front view of an illustrative embodiment of a recreational chair having a dinner tray and beverage tray in the deployed configuration.
Figure 2:
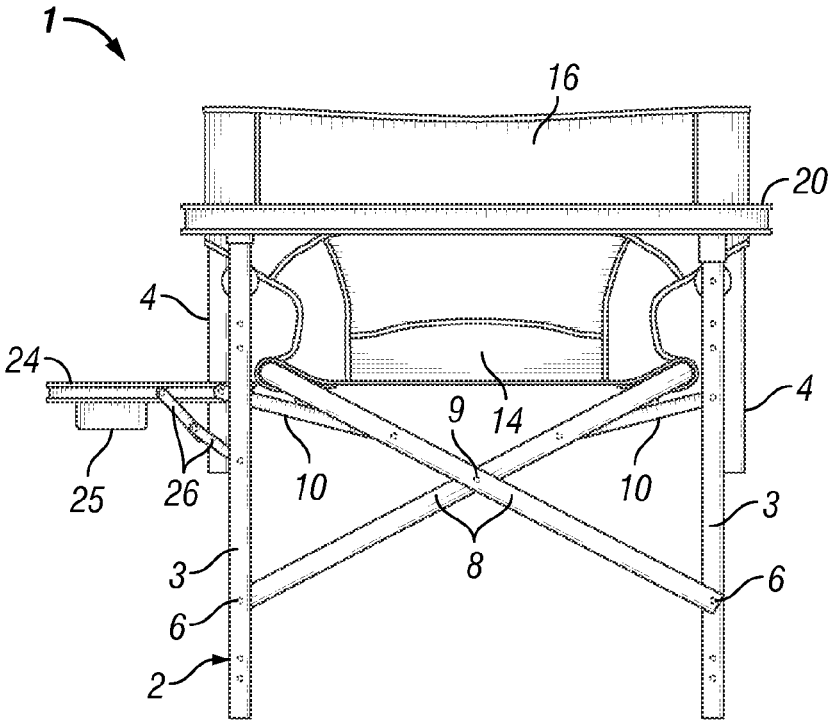
FIG. 2 is a front view of the chair of FIG. 1.
Figure 3:
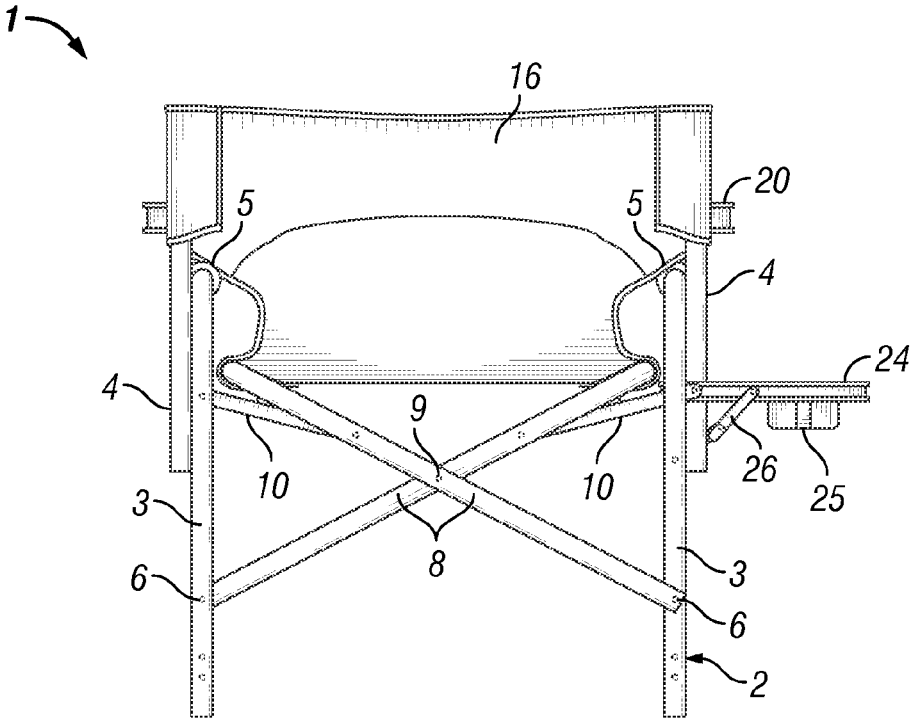
FIG. 3 is a rear view of the chair of FIG. 1.
Figure 8:
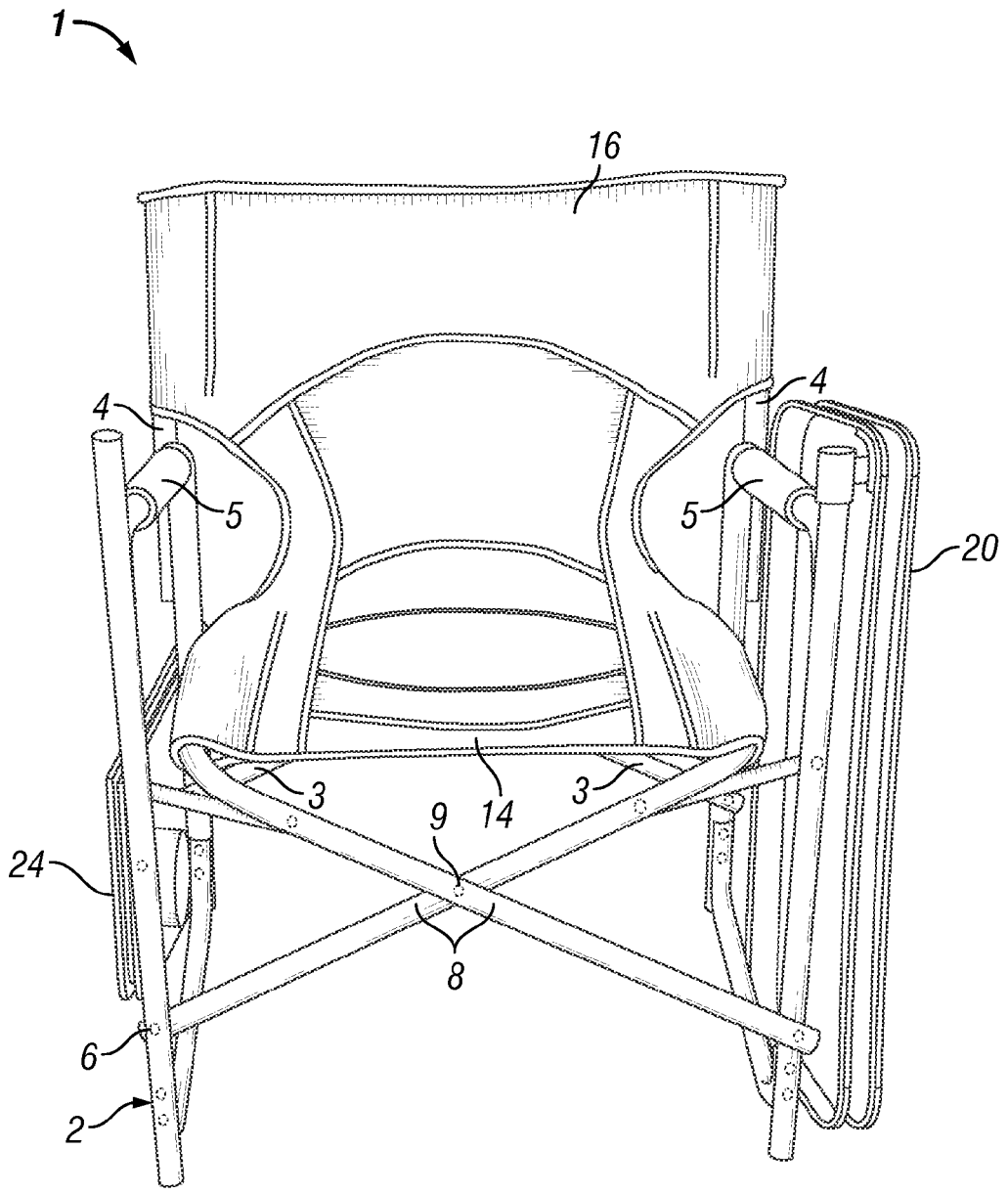
FIG. 8 is a front perspective view of the chair of FIG. 1 with beverage and dinner trays in the undeployed position.
Figure 9A:
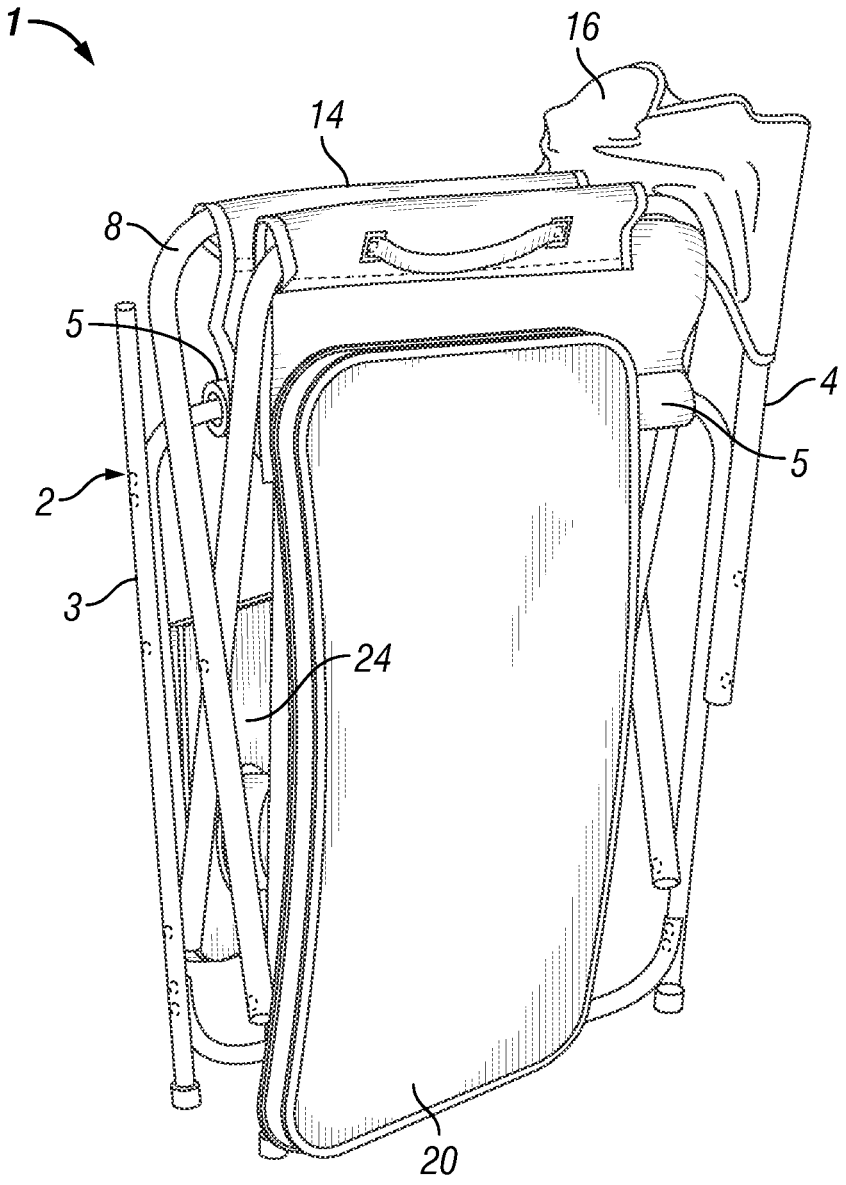
FIG. 9A is a left side perspective view of the chair in FIG. 1 in a collapsed configuration.

A table top tray 20 may be pivotally attached to one of the side frame portions 3 of the chair frame 2 in such a manner that the table top tray 20 can be selectively deployed in the extended, functional position illustrated in FIG. 1 or the folded position illustrated in FIGS. 8 and 9A. The table top tray 20 may be attached to the side frame portion 3 according to any technique which is suitable for the purpose.

An exemplary table pivot/swivel mechanism 130 which is suitable for the purpose is illustrated in FIGS. 12-16. The table pivot/swivel mechanism 130 pivotally and swivelly attaches the table top tray 20 to side frame portion 3 via a tray bracket 140 which is attached to the table top tray 20, an armature 136 which engages the tray bracket 140, a pivot sleeve 142 which is mounted on the side frame portion 3 of the chair frame 2 and a ball joint 138 which is formed between the armature 136 and the pivot sleeve 142. The tray bracket 140 may be fixed to the table top tray 20 via set screws 144. The table pivot/swivel mechanism 130 allows the table top tray 20 to pivot up with the armature 136 from a stored or undeployed position (FIG. 13B). When the table top tray 20 is parallel in the deployed position (FIG. 13A), the pivot sleeve 142 allows the table top tray 20 to swivel and rotate around to position the table top tray 20 in place.

A beverage tray 24 may be pivotally attached to one of the side frame portions 3 of the chair frame 2. The beverage tray 24 may be attached to the side frame portion 3 via at least one folding tray support arm 26. One of the seat frame stabilizing arms 10 may additionally attach the beverage tray 24 to one of the seat frame members 8. Accordingly, the beverage tray 24 can be selectively deployed in the functional, extended configuration illustrated in FIG. 1 or the folded position illustrated in FIG. 8. In some embodiments, at least one cup holder 25 may be provided in the beverage tray 24 to receive and support a beverage (not illustrated) on the beverage tray 24.

Figure 9B:
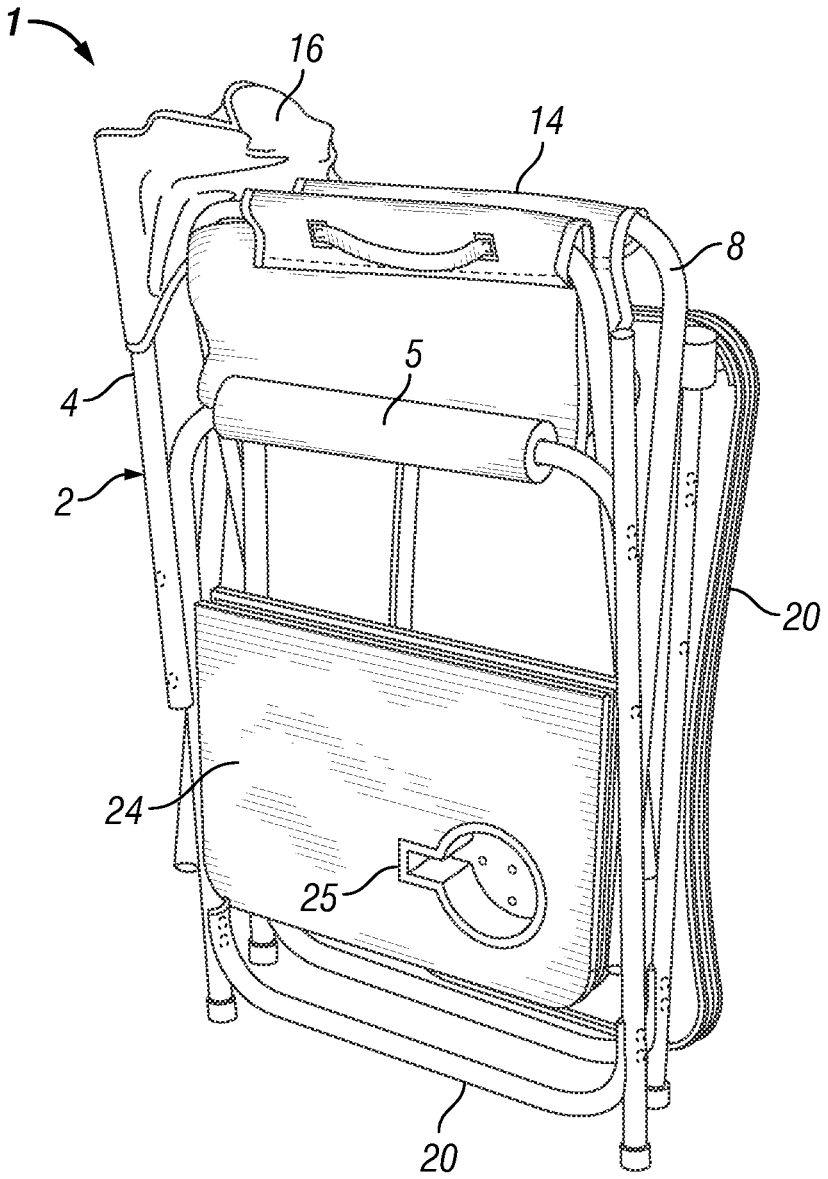
FIG. 9B is a right side perspective view of the chair in FIG. 1 in the collapsed configuration.

In exemplary application, the recreational chair 1 can be selectively deployed in the extended, functional position illustrated in FIG. 8 to support a user (not illustrated) on the seat 14 and against the backrest 16. The user's arms can be rested on the respective armrests 5. The table top tray 20 can be selectively deployed from the folded position illustrated in FIG. 8 to the extended position illustrated in FIG. 1 to support one or various items such as a plate of food (not illustrated) as the user eats, for example. The beverage tray 24 can be selectively deployed from the folded position illustrated in FIG. 8 to the extended position illustrated in FIG. 1 to support additional items such as a beverage (not illustrated) which may be seated in the cup holder 25. After use, the table top tray 20 and the beverage tray 24 can be returned to the folded positions in FIG. 8 and the chair frame 2 can be selectively collapsed to a compact size, as illustrated in FIGS. 9A and 9B, for storage and/or transport.

Figure 10:
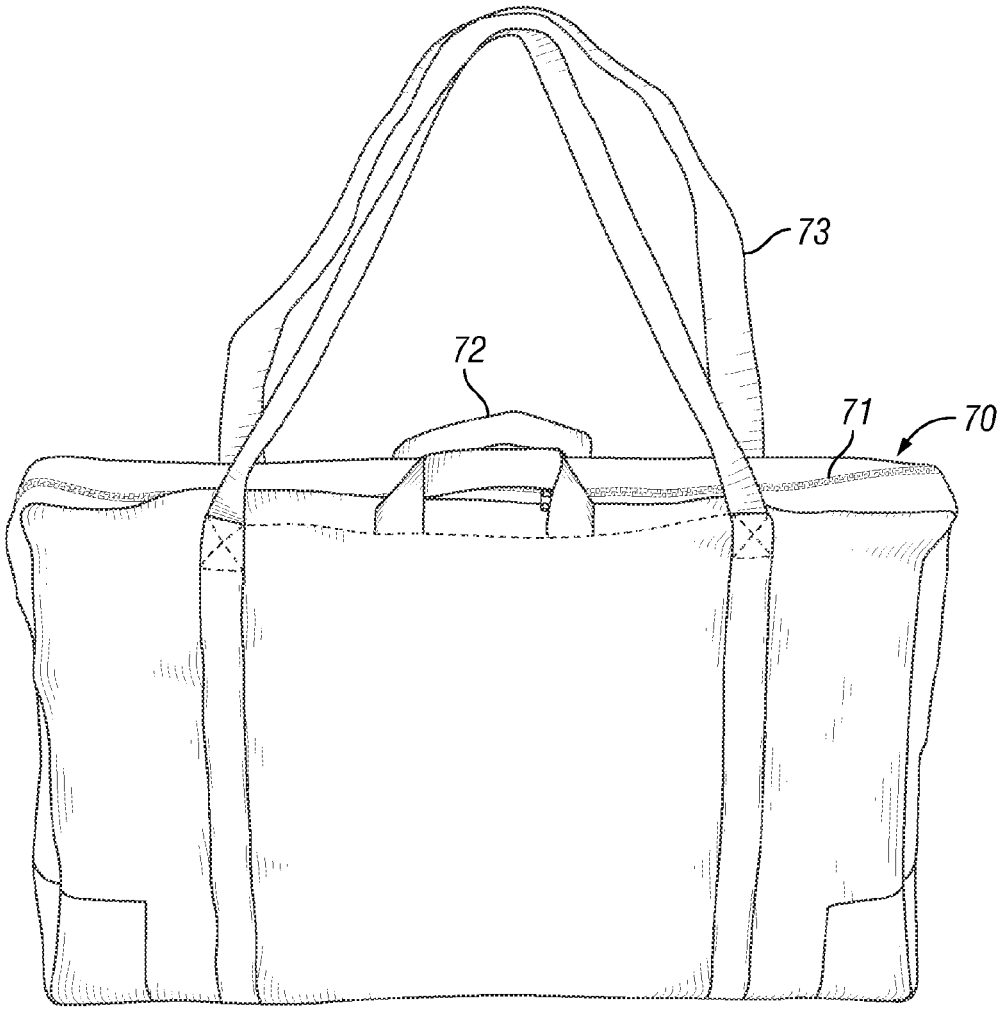
FIG. 10 is a side view of a carrying bag for the recreational chair according to the present invention.
Figure 11:
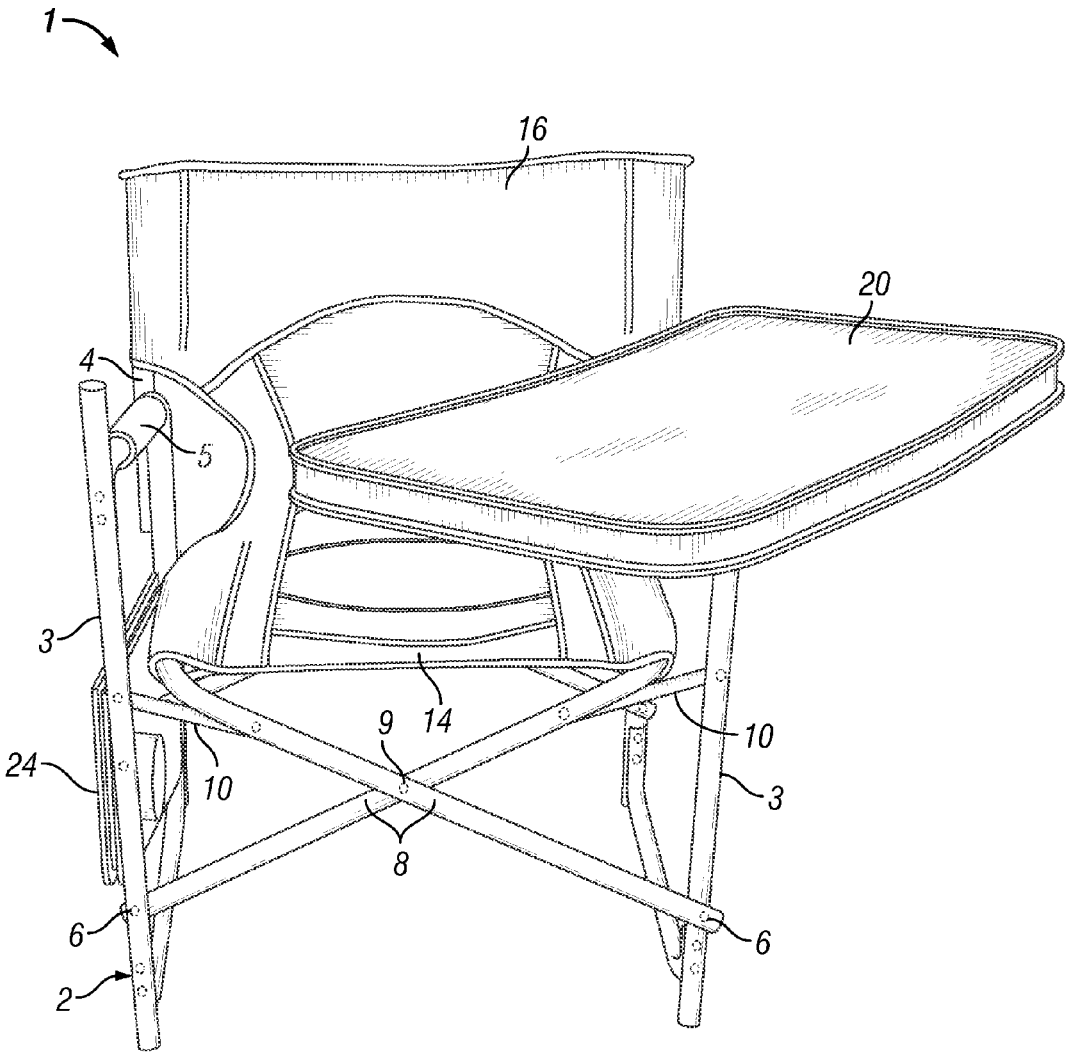
FIG. 11 is a front perspective view of the chair of FIG. 1 showing the dinner tray partially deployed.
Figure 12:
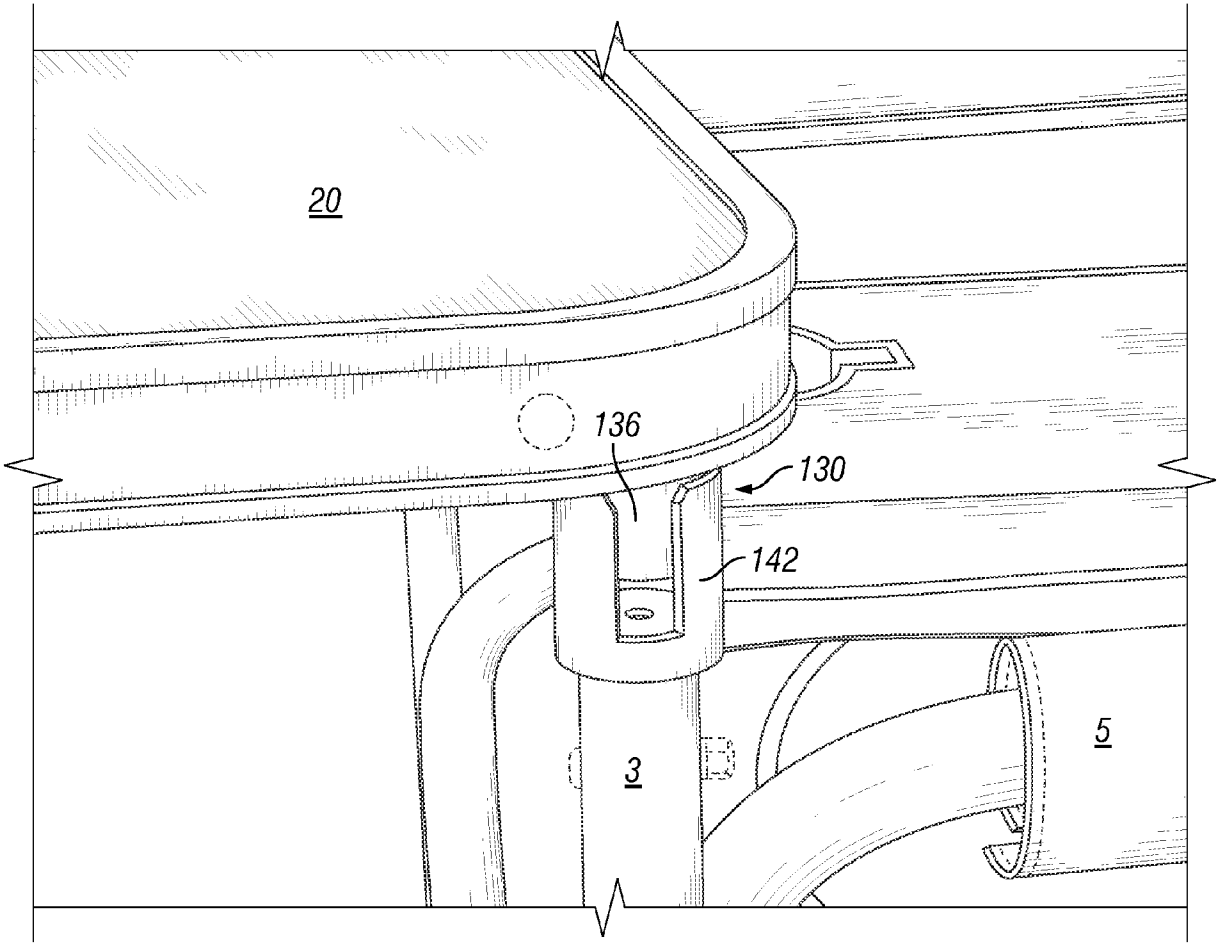
FIG. 12 is a left side perspective close up view of a swivel/pivot mechanism which is suitable for the chair of FIGS. 1-11, according to the present invention.
Figure 13A:
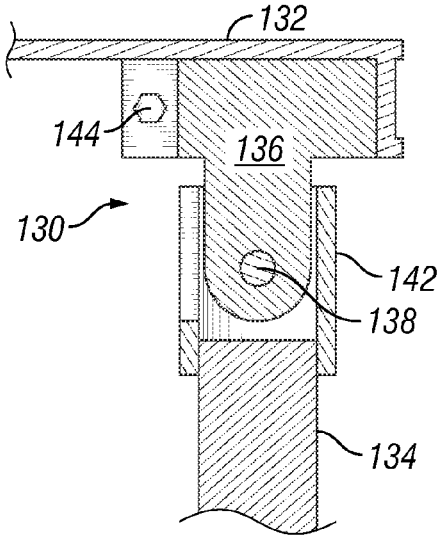
FIG. 13A left side enlarged view of the swivel/pivot mechanism of FIG. 12 illustrating the table top tray in the deployed configuration.
Figure 13B:
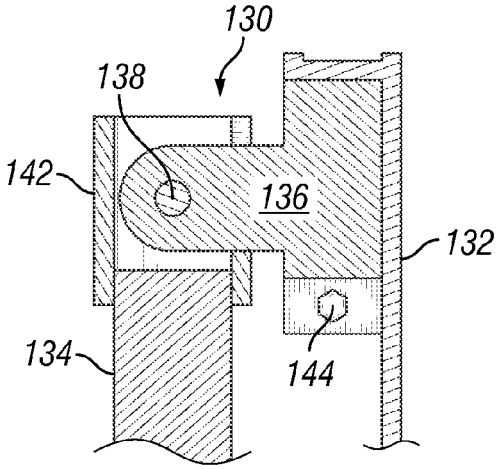
FIG. 13B is a front enlarged view of the swivel/pivot mechanism of FIG. 12 illustrating the table top tray in the undeployed configuration.
Figure 13C:
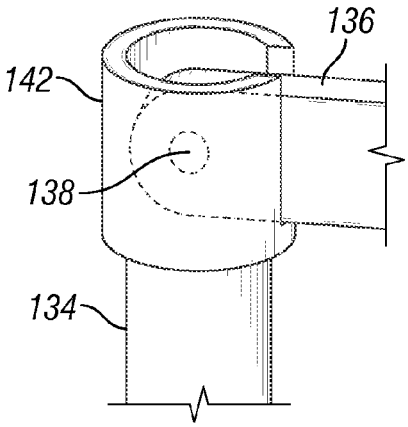
FIG. 13C is a right side perspective view of the armature and sleeve of the swivel/pivot mechanism of FIG. 13B.
Figure 13D:
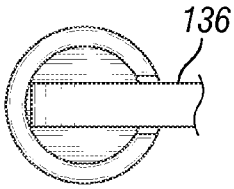
FIG. 13D is a top view of the armature and sleeve of the swivel/pivot mechanism of FIG. 13C.
Figure 13E:
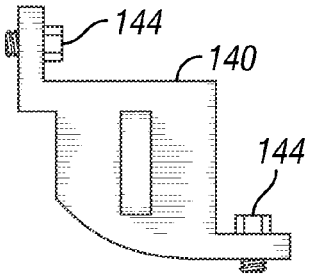
FIG. 13E is a top view of the attachment mechanism that attaches the table top to the armature of FIG. 13D.
Figure 14:
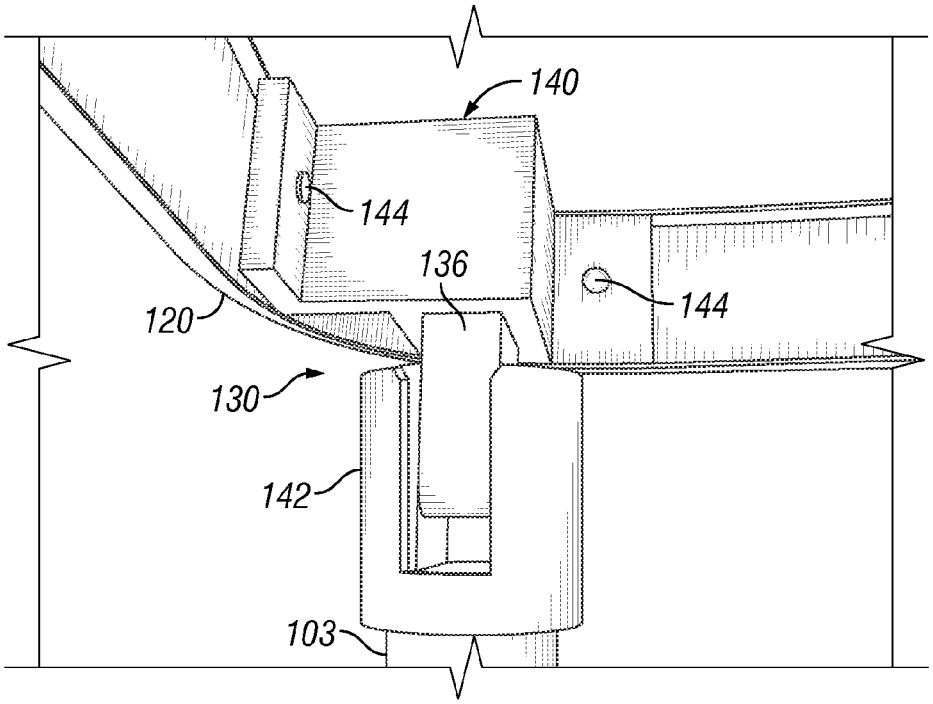
FIG. 14 is left side perspective view of a tray swivel mechanism of the heated chair of FIG. 14.
Figure 15:
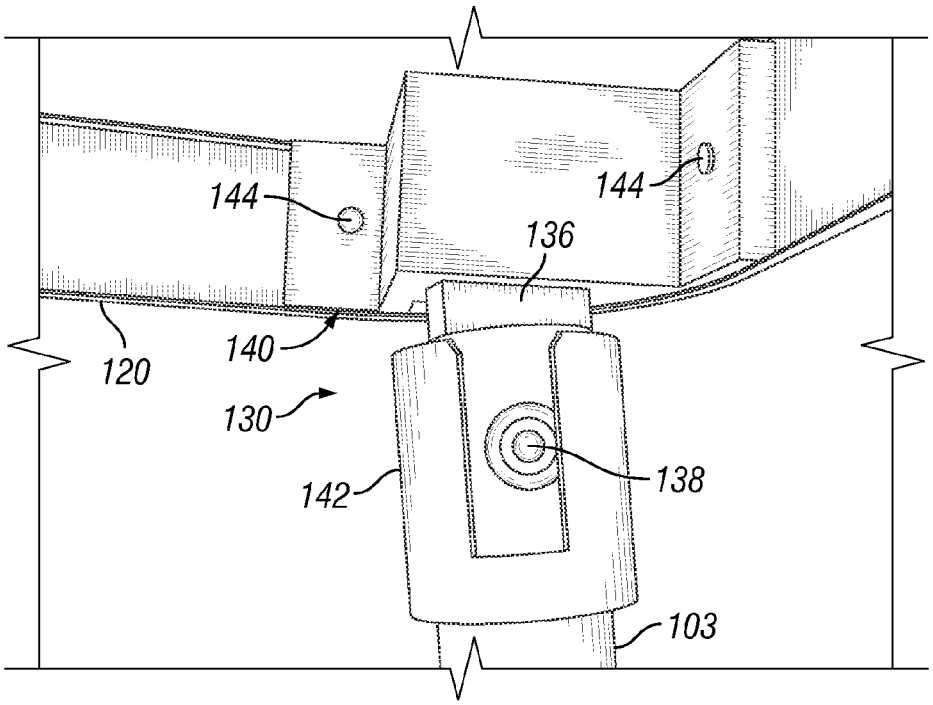
FIG. 15 is front perspective view of the tray swivel mechanism of the heated chair of FIG. 14.
Figure 16:
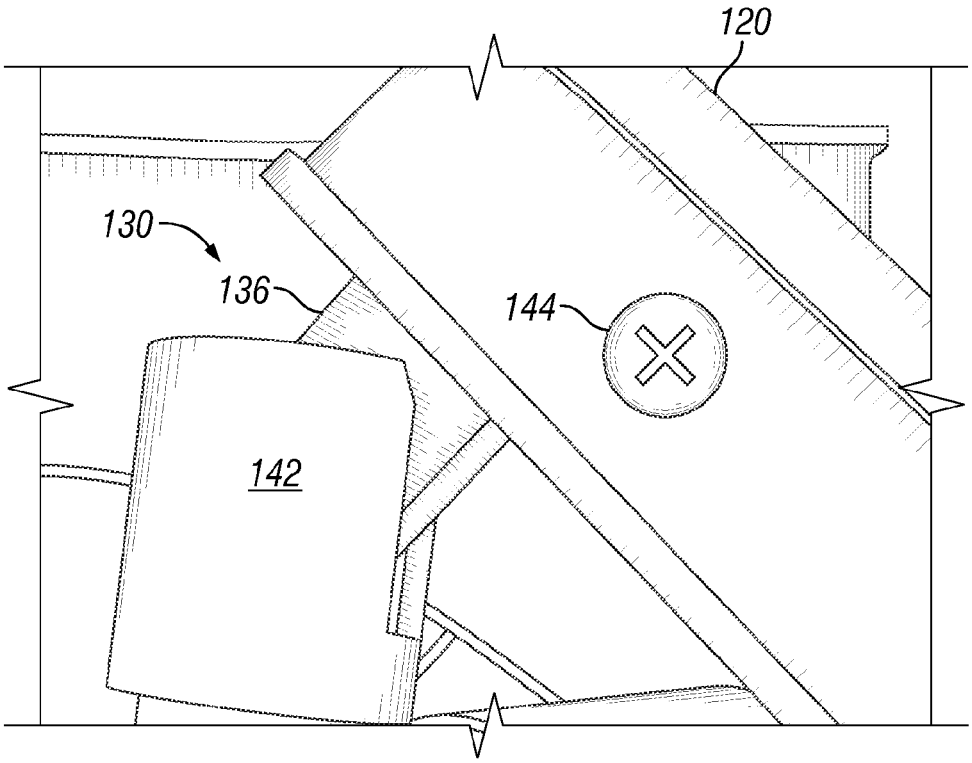
FIG. 16 is rear perspective of the tray and tray swivel mechanism showing the tray in a partially deployed position.

As illustrated in FIG. 10, in some embodiments, the folded or collapsed recreational chair 1 can be placed in a carrying case 70 for storage and/or transport. The carrying case 70 may be vinyl or other material and may be selectively opened and closed by manipulation of a zipper 71. The carrying case 70 may be fitted with at least one of a handle 72 and a strap 73.

Figure 17:
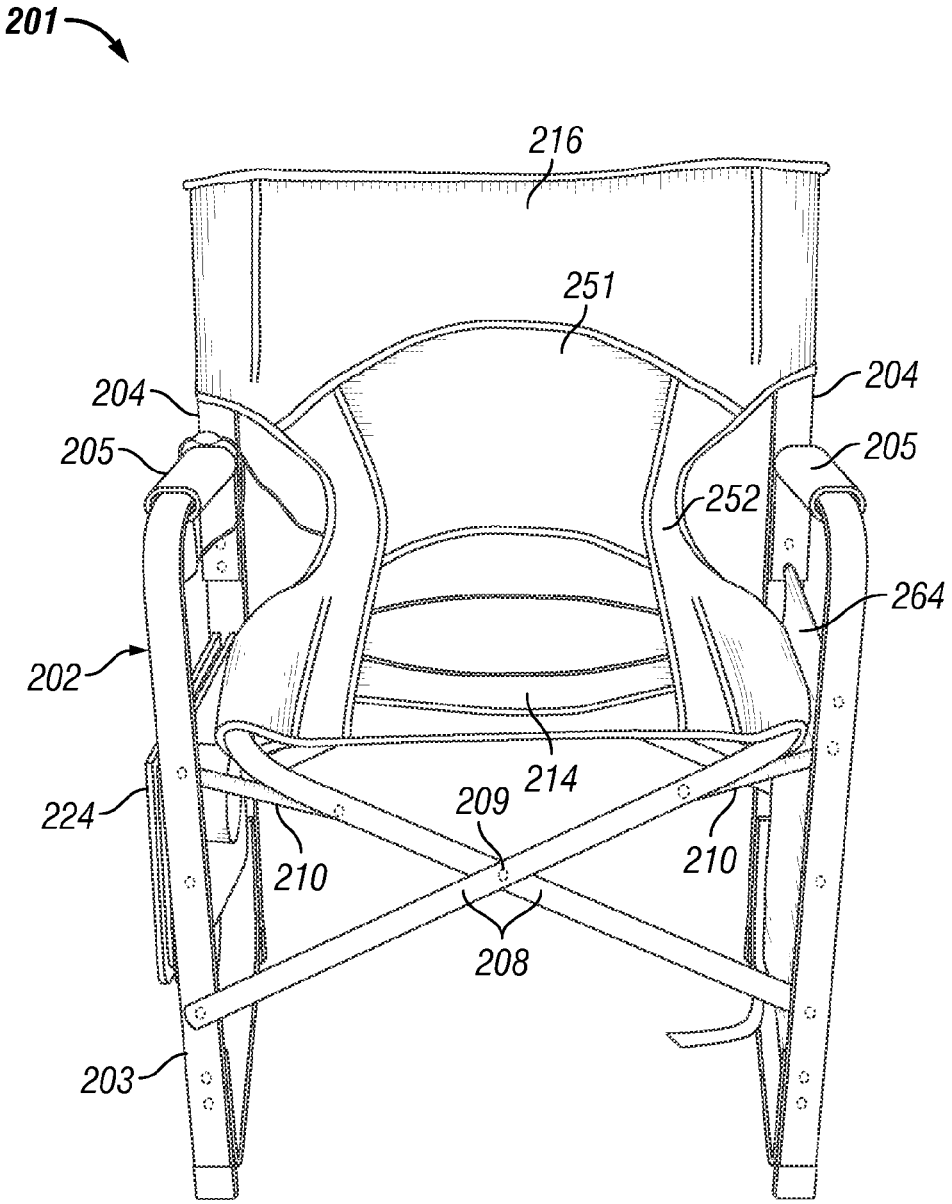
FIG. 17 is a perspective front view of an illustrative embodiment of a heated recreational chair having a beverage tray in the undeployed configuration.
Figure 18:
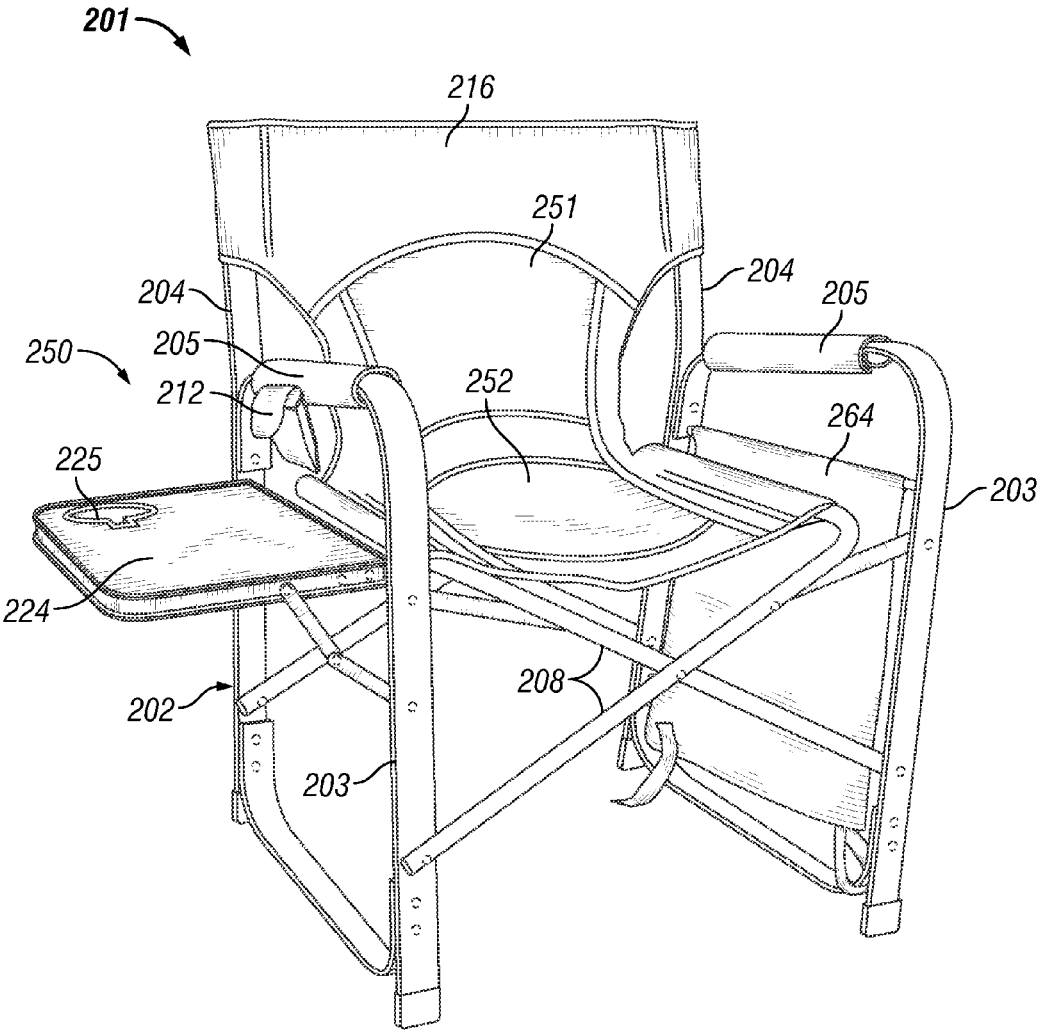
FIG. 18 is a perspective front view of the heated chair of FIG. 17 with the beverage tray in the deployed configuration.
Figure 19:
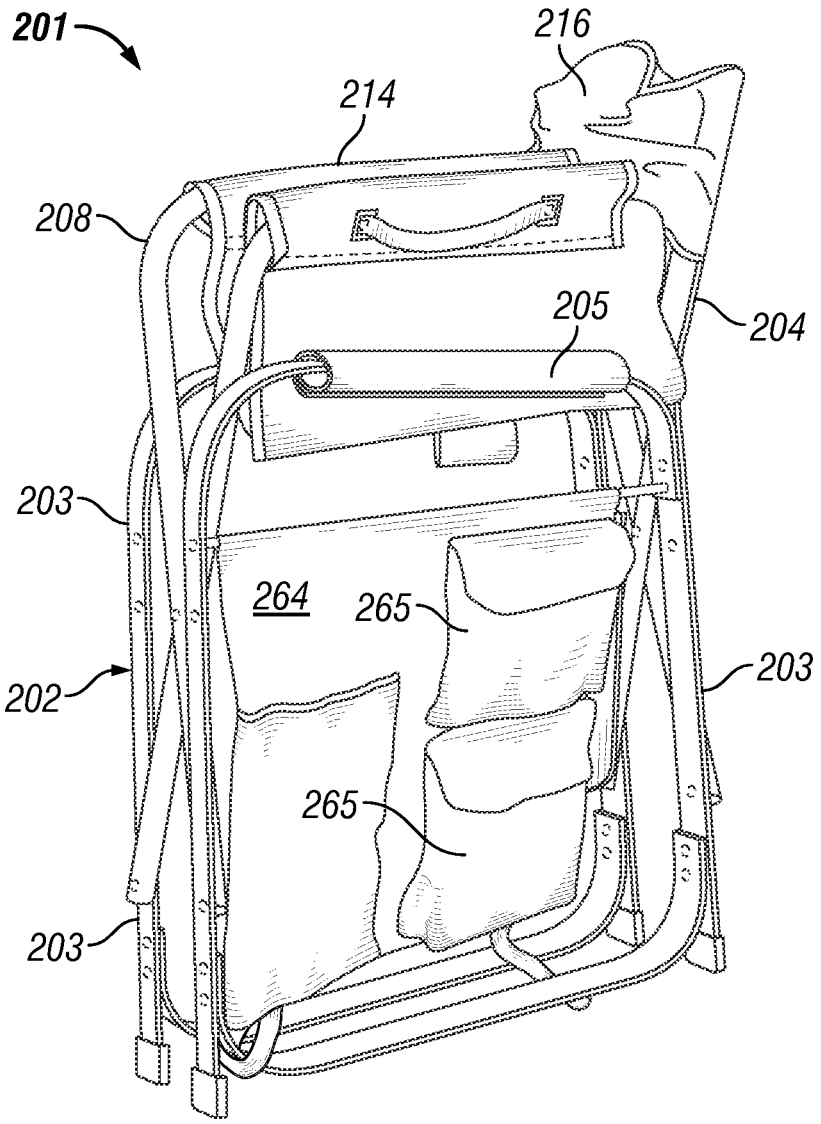
FIG. 19 is perspective front view of the heated chair in FIG. 17 in the collapsed configuration and illustrating left side storage compartments.
Figure 20:
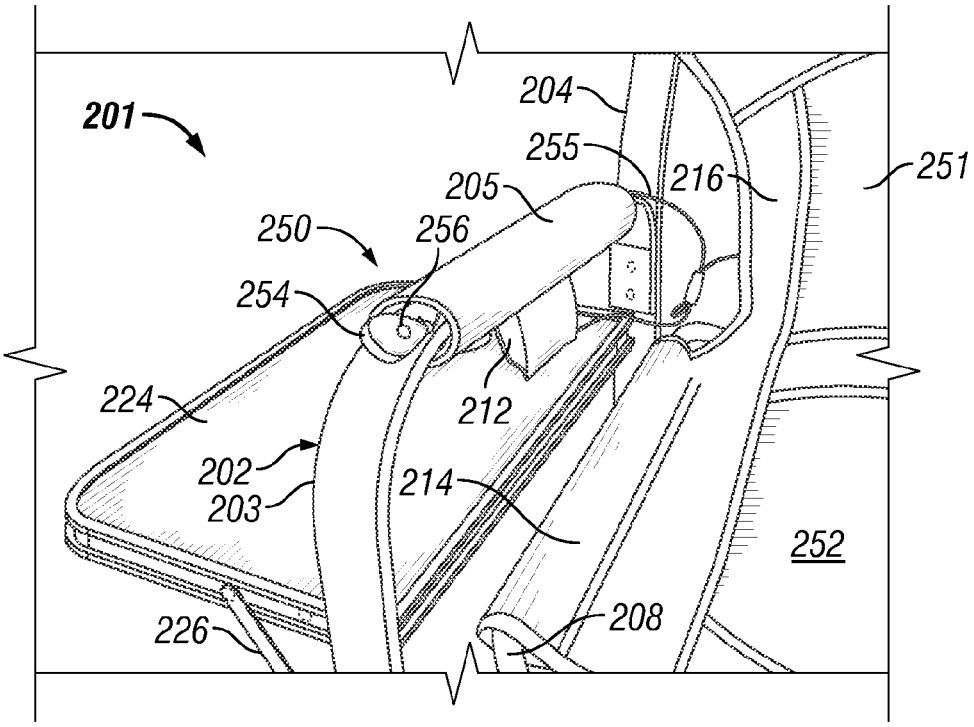
FIG. 20 is a partial front perspective view of the heated chair of FIG. 17 illustrating a control module of a heating mechanism for the chair.
Figure 21:
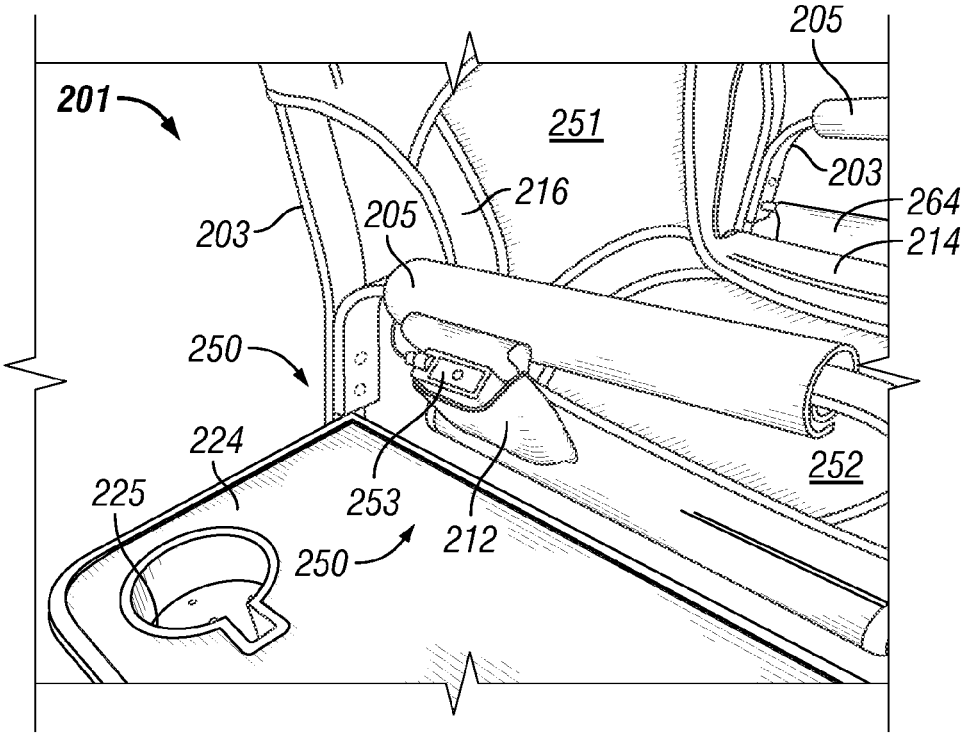
FIG. 21 is a partial side perspective view of the heated chair of FIG. 17 illustrating a battery pack inserted in a battery pack pouch provided on the chair.

Referring next to FIGS. 17-26 of the drawings, an illustrative embodiment of a heated recreational chair is generally indicated by reference numeral 201. The heated recreational chair 201 may have a design which is similar to that of the heated recreational chair 1 heretofore described with respect to FIGS. 1-13. In the heated recreational chair 201 illustrated in FIGS. 14-26, elements which are analogous to the respective elements of the heated recreational chair 1 (FIGS. 1-13) are designated by the same numerals in the 200 series. The heated recreational chair 201 may include a heating mechanism 250 (FIG. 19) which can be selectively operated to heat the backrest heating unit 251 and/or the seat heating unit 252. As illustrated in FIG. 19, the heating mechanism 250 may include a backrest heating unit 251 which is incorporated into the backrest 216 and a seat heating unit 252 which is incorporated into the seat 214 of the heated recreational chair 201. In some embodiments, the backrest heating unit 251 and the seat heating unit 252 may be placed in interior pockets (not illustrated) in the backrest 216 and the seat 214, respectively. In other embodiments, the backrest heating unit 251 and the seat heating unit 252 may be attached to exterior surfaces of the backrest 216 or the seat 214. In still other embodiments, the backrest heating unit 251 and the seat heating unit 252 may be attached to or incorporated into the backrest 216 and the seat 214, respectively, using alternative techniques known by those skilled in the art.

A battery pack 253, which may be rechargeable in some embodiments, may be electrically connected to the backrest heating unit 251 and the seat heating unit 252 via wiring 255. A control module 254 may be electrically connected to the backrest heating unit 251 and the seat heating unit 252 via wiring 255. The control module 254 may include at least one button 256. Accordingly, the control module 254 may be adapted to facilitate heating of the backrest heating unit 251 and the seat heating unit 252 by manipulation of the button 256 on the control module 254. In some embodiments, the control module 254 may have multiple settings such as "low", "medium" and "high", for example and without limitation.

As illustrated in FIG. 17, in some embodiments, the control module 254 may be located in front of the armrest 205 and the wiring 255 which connects the control module 254 to the battery pack 253 of the heating mechanism 250 may extend through the armrest 205. This position of the control module 254 may provide ease of access of the user to the control module 254. As illustrated in FIG. 18, in some embodiments, a battery pack pouch 212 may be attached to the armrest 205 via sewing or other attachment technique. The battery pack 253 may be contained in the battery pack pouch 212 for convenience of access.

Figure 23:
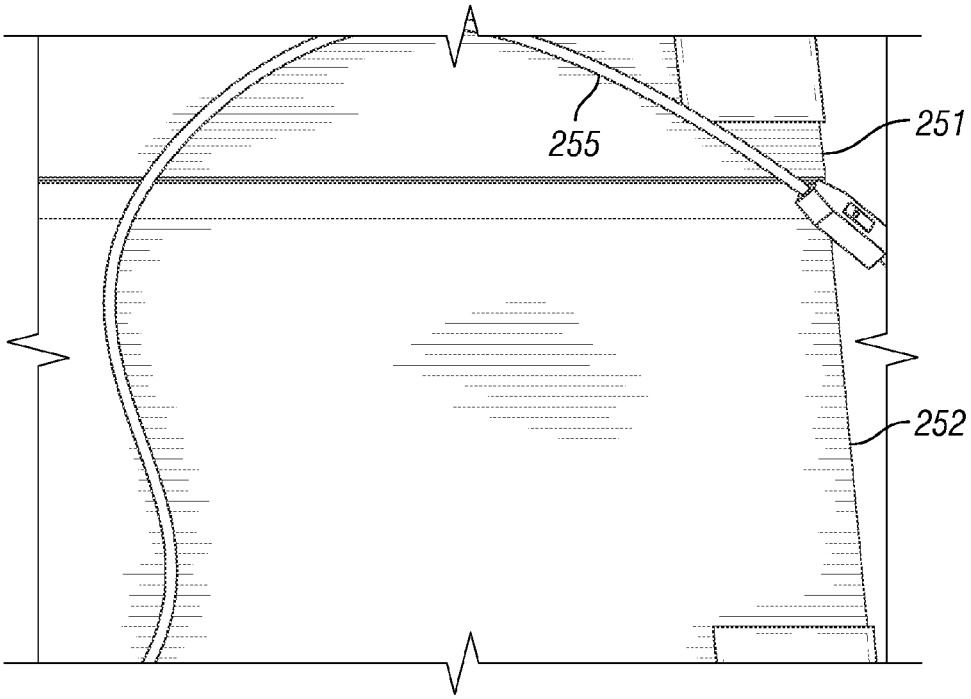
FIG. 23 is a top perspective view of the carbon fiber backrest heating unit and seat heating unit of the heating mechanism illustrated in FIG. 17.
Figure 24:
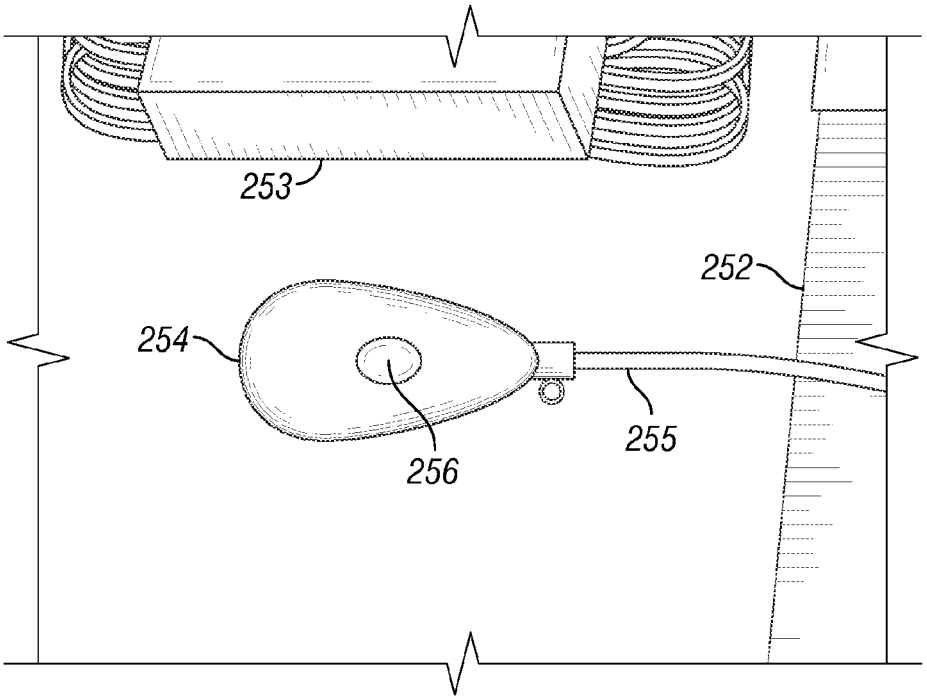
FIG. 24 is a top perspective view of a control module of the heating mechanism illustrated in FIG. 17.
Figure 25:
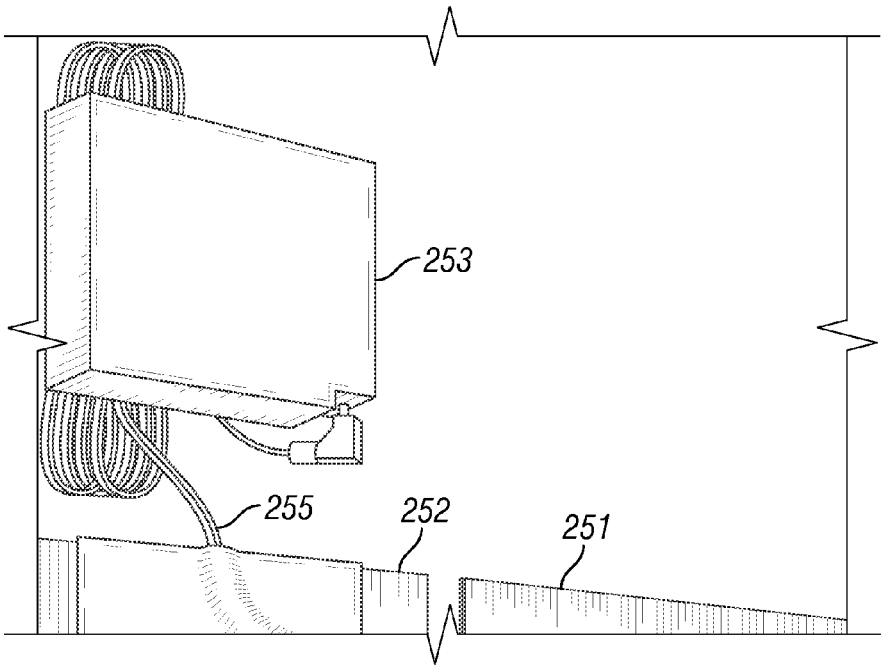
FIG. 25 is a top perspective view of the rechargeable battery of the heating mechanism illustrated in FIG. 17.
Figure 26:
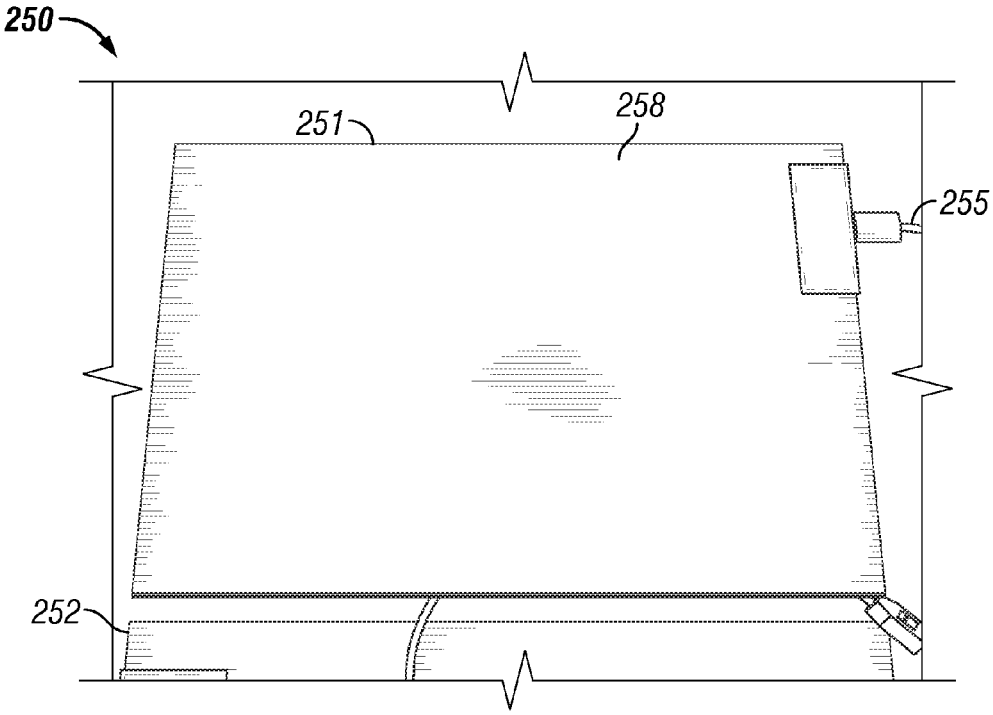
FIG. 26 is a top perspective view of a foil backing of the backrest heating unit of the heating mechanism illustrated in FIG. 17.

An exemplary design for the backrest heating unit 251 (and the seat heating unit 252) is illustrated in FIG. 23. Heating elements (not illustrated) may be covered or enveloped by a foil backing 258 or other thermally-insulating material. The heating elements may be electrically connected to the wiring 255 which connects the backrest heating unit 251 to the battery pack 253. Alternative designs which are known or can be contrived by those skilled in the art are possible for the heating mechanism 250.

As illustrated in FIGS. 17-19, in some embodiments, a pouch panel 264 may be provided on a side frame portion 203 of the chair frame 202. In some embodiments, the pouch panel 264 may be provided on the left-hand side frame portion 203 opposite the beverage tray 224, as illustrated. As illustrated in FIG. 19, at least one pouch 265 may be provided on the outer surface of the pouch panel 264 to contain any of various items. In some embodiments, multiple pouches 265 may be provided on the outer surface of the pouch panel 264, as illustrated.

In exemplary application, the recreational chair 201 can be selectively deployed in the extended, functional position illustrated in FIGS. 17 and 18 to support a user (not illustrated) on the seat 214 and against the backrest 216. The user's arms can be rested on the respective armrests 205. The beverage tray 224 can be selectively deployed from the folded position illustrated in FIG. 17 to the extended position illustrated in FIG. 18 to support additional items such as a beverage (not illustrated) which may be seated in the cup holder 225. Various items (not illustrated) may be placed in one or more of the pouches 265 (FIG. 19) on the pouch panel 264. After use, the beverage tray 224 can be returned to the folded positions in FIG. 17 and the chair frame 202 can be selectively collapsed to a compact size, as illustrated in FIG. 19, for storage and/or transport.

Figure 27:
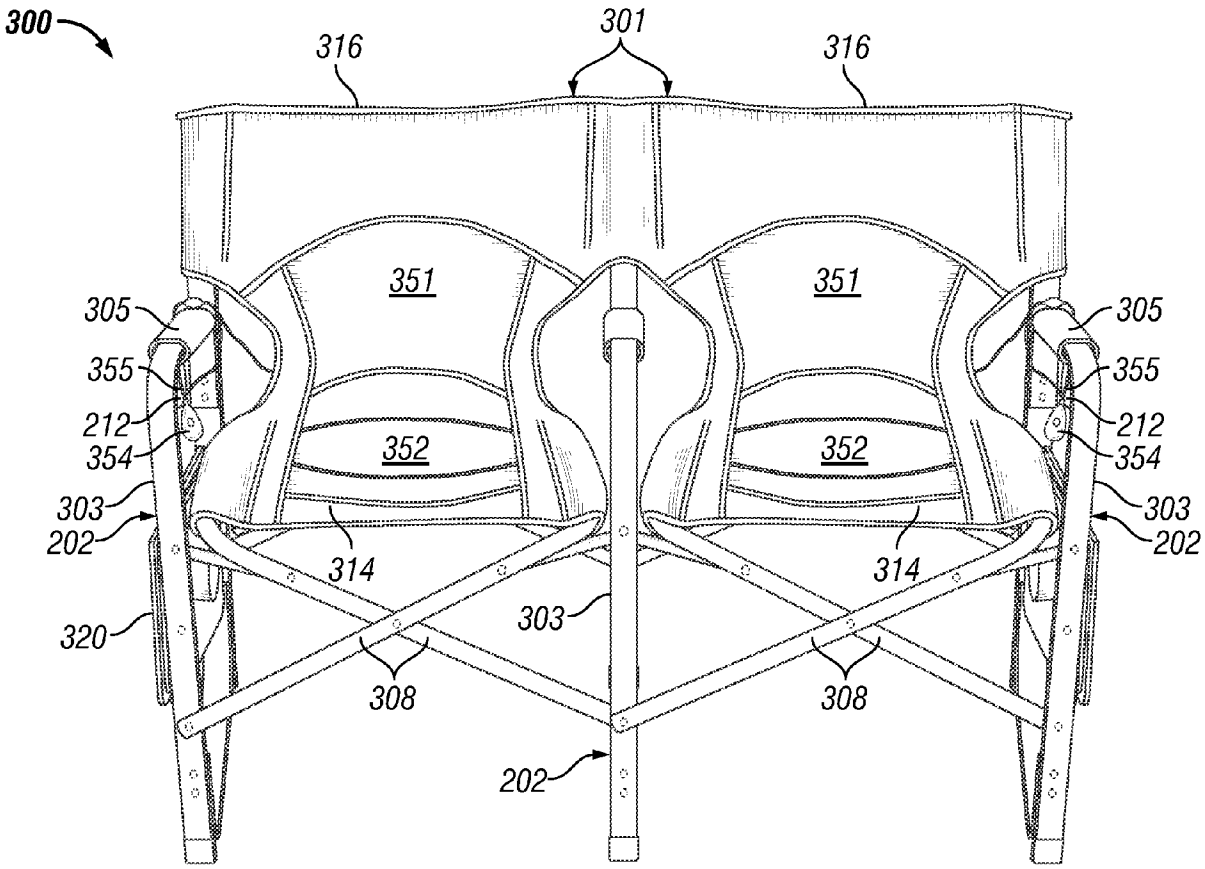
FIG. 27 is a front perspective front view of an illustrative embodiment of a double-heated chair having a pair of beverage trays in the undeployed configuration.
Figure 28:
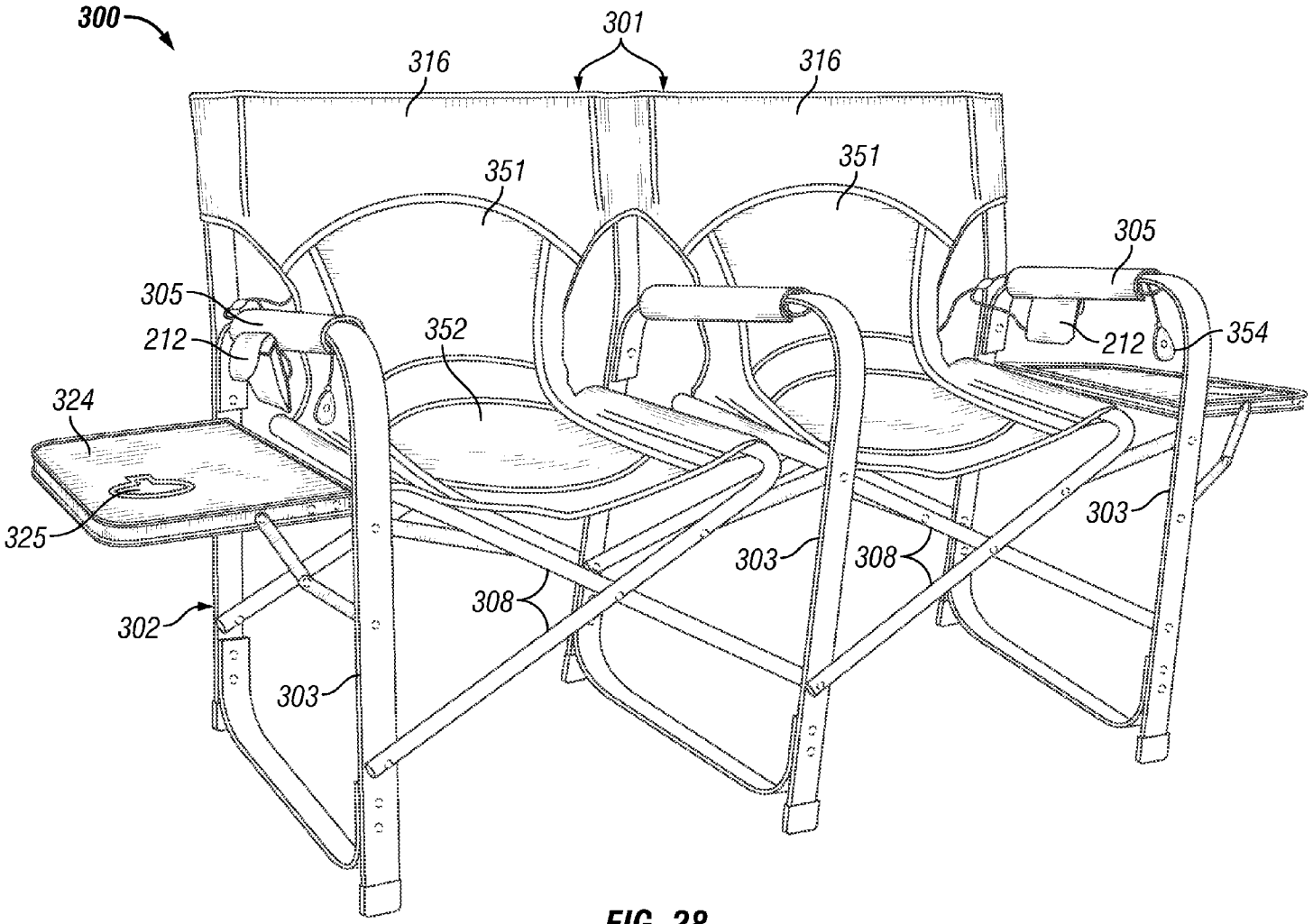
FIG. 28 is a perspective front view of the double-heated chair of FIG. 27 with the beverage trays in the deployed configuration.
Figure 29:
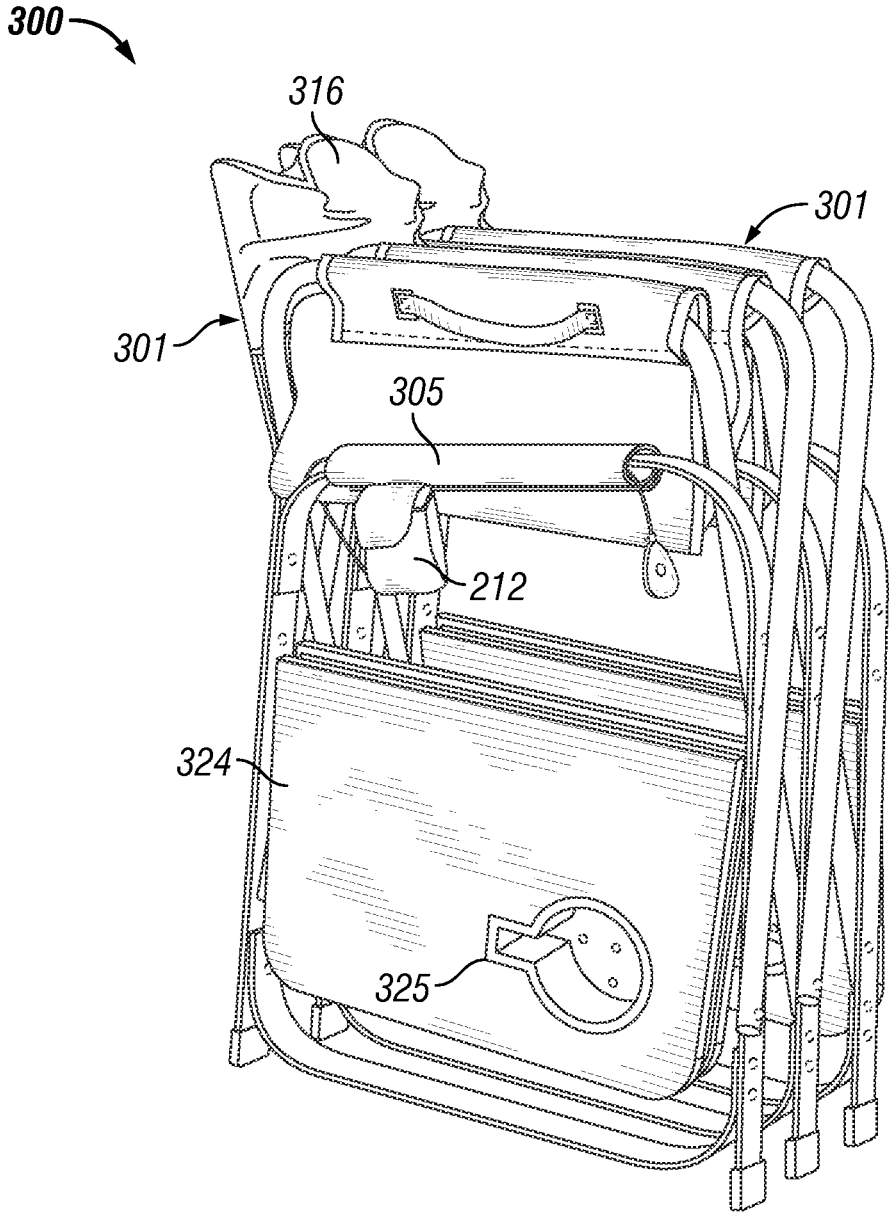
FIG. 29 is perspective front view of the double-heated chair of FIG. 27 in the collapsed configuration.

Referring next to FIGS. 27-29 of the drawings, an illustrative embodiment of a double heated recreational chair is generally indicated by reference numeral 300. The double heated recreational chair 300 includes a pair of single heated recreational chairs 301 which are integrally attached to each other. Each single heated recreational chair 301 may have a design which is similar to that of the heated recreational chair 201 which was heretofore described with respect to FIGS. 17-21. In each single heated recreational chair 301 of the double heated recreational chair 300 illustrated in FIGS. 27-29, elements which are analogous to the respective elements of the heated recreational chair 201 (FIGS. 17-21) are designated by the same numerals in the 300 series. The single heated recreational chairs 301 may have a central chair frame 302 in common. Accordingly, when the double heated recreational chair 300 is deployed in the extended, functional position illustrated in FIGS. 27 and 28, the single heated recreational chairs 301 are capable of accommodating a pair of users (not illustrated) as the users sit on the seats 314 and against the backrests 316 of the respective single heated recreational chairs 301. Each single heated recreational chair 301 may have its own independently-operated heating mechanism 250 which enables the users to selectively heat the seat 314 and the backrest 316. When not in use, the double heated recreational chair 300 can be deployed in the folded or collapsed position illustrated in FIG. 29 for storage and/or transportation purposes.

Figure 31:
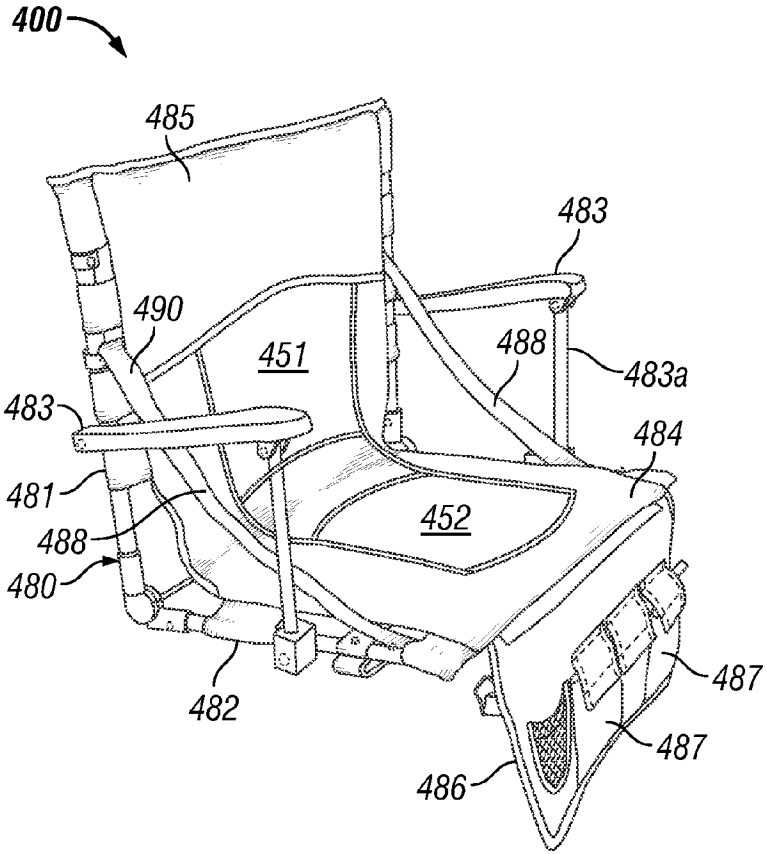
FIG. 31 is a side perspective view of the heated stadium chair of FIG. 27.
Figure 30:
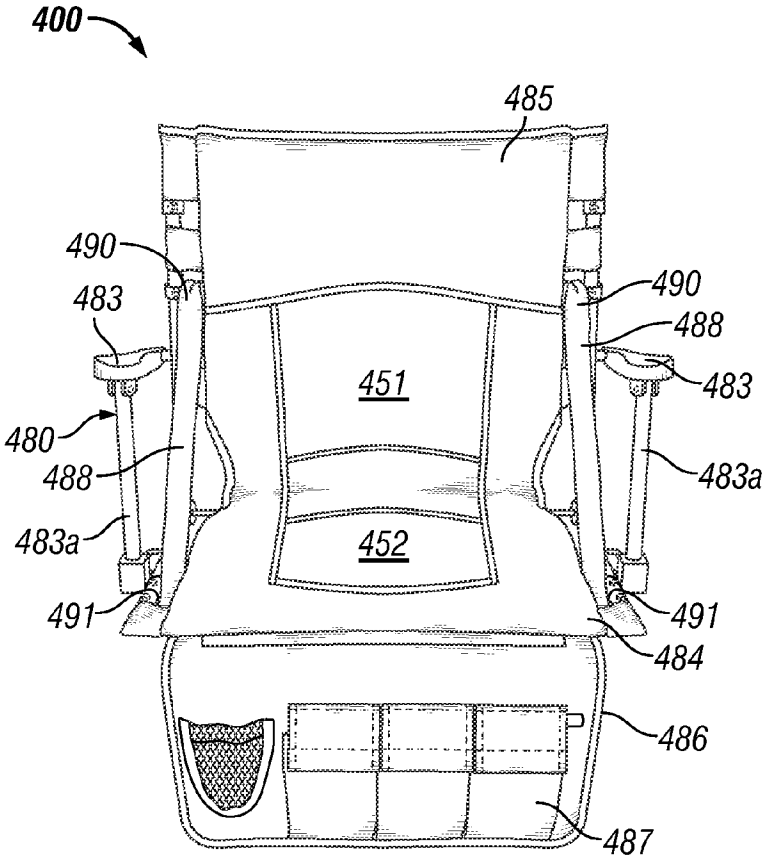
FIG. 30 is a front view of an illustrative embodiment of a heated stadium chair in the deployed configuration.

Referring next to FIGS. 30-37 of the drawings, an illustrative embodiment of a heated stadium chair is generally indicated by reference numeral 400. The heated stadium chair 400 may include a chair frame 480 having a backrest frame portion 481 and a seat frame portion 482 which extends from the backrest frame portion 481. The backrest frame portion 481 may be pivotally attached to the seat frame portion 482, as illustrated. Armrests 483 may be provided on respective sides of the chair frame 480. A rear end of each armrest 483 may be pivotally attached to the backrest frame portion 481. A front end of each armrest 483 may be pivotally attached to an upper end of an armrest support 483*a*. The lower end of each armrest support 483 may be pivotally attached to the seat frame portion 482. Accordingly, each armrest 483 pivots with respect to the backrest frame portion 481 and the corresponding armrest support 483 and the armrest support 483 pivots with respect to the seat frame portion 482 as the heated stadium chair 40 is deployed between the collapsed configuration (FIGS. 34-36) and the functional configuration (FIGS. 30 and 31).

Figure 34:
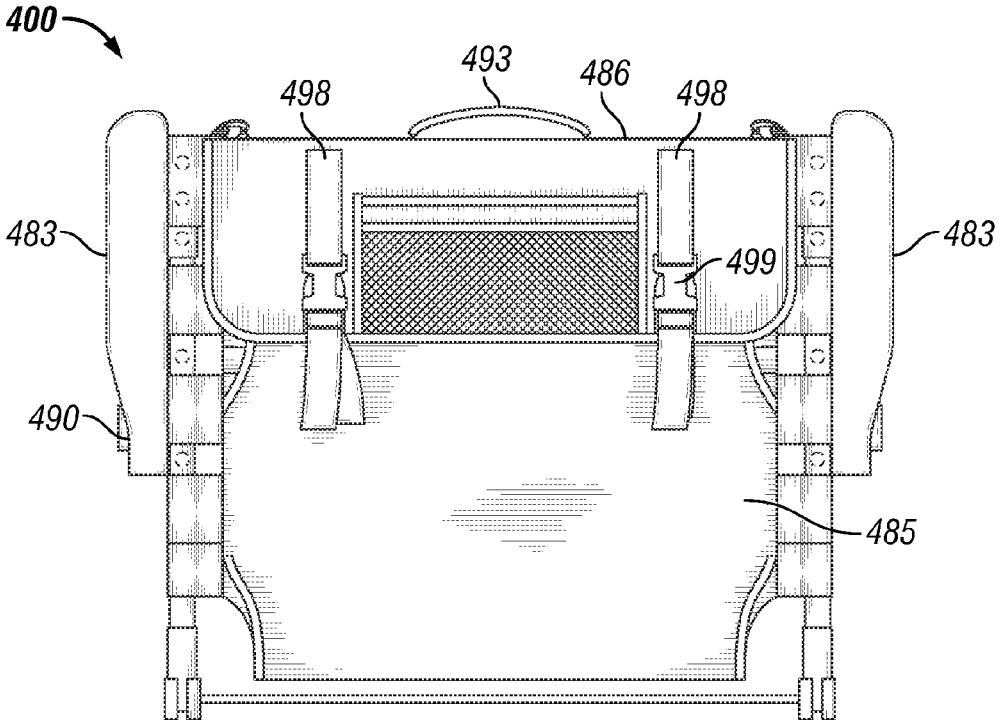
FIG. 34 is a front view of the heated stadium chair in the undeployed configuration.
Figure 35:
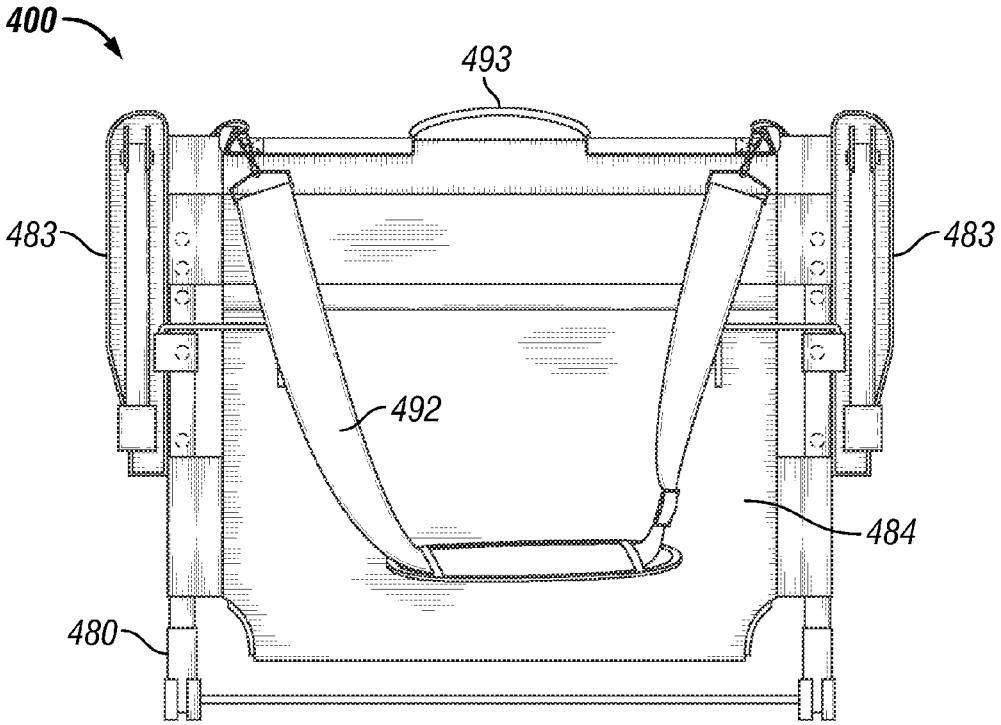
FIG. 35 is a rear view of the undeployed or folded heated stadium chair of FIG. 34.
Figure 36:
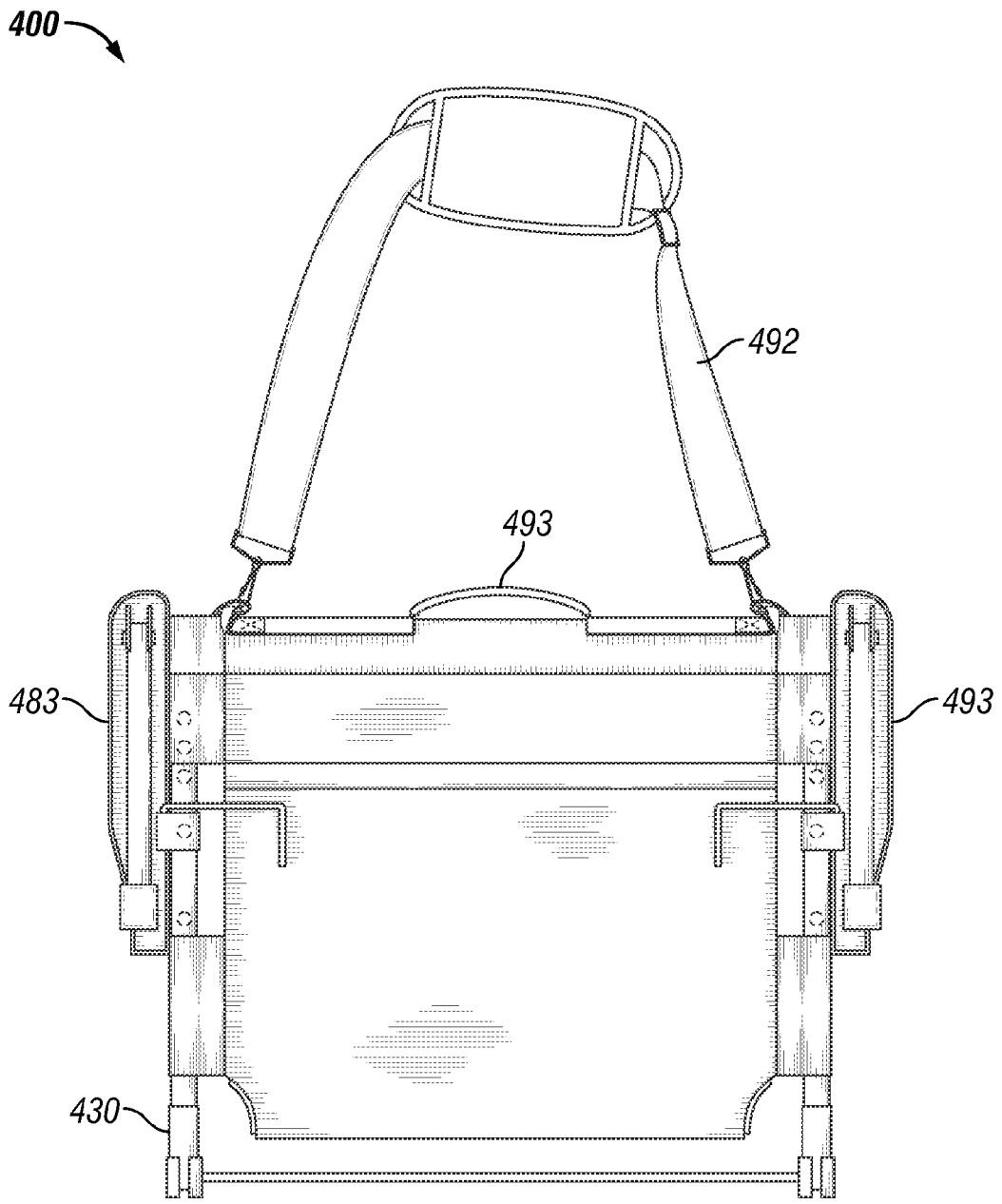
FIG. 36 is a rear view of the heated stadium chair of FIG. 21, illustrating a removable shoulder strap.

A seat 484 and a backrest 485 may be provided on the seat frame portion 482 and the backrest frame portion 481, respectively, of the chair frame 480. Each of the seat 484 and the backrest 485 may be a fabric material. The heated stadium chair 400 can be selectively deployed in the extended, functional configuration illustrated in FIGS. 30 and 31 or in the folded or collapsed configuration for storage and/or transport, as illustrated in FIGS. 34-36, as will be hereinafter further described.

A heating mechanism 450 may include a backrest heating unit 451 which is provided in the backrest 485 and a seat heating unit 452 which is provided in the seat 484. In some embodiments, a combined controller/power source 460 may be electrically connected to the backrest heating unit 451 and the seat heating unit 452. In other embodiments, the controller and the power source for the backrest heating unit 451 and the seat heating unit 452 may be separate. The controller/power source 460 may include one or more rechargeable batteries (not illustrated).

Figure 32:
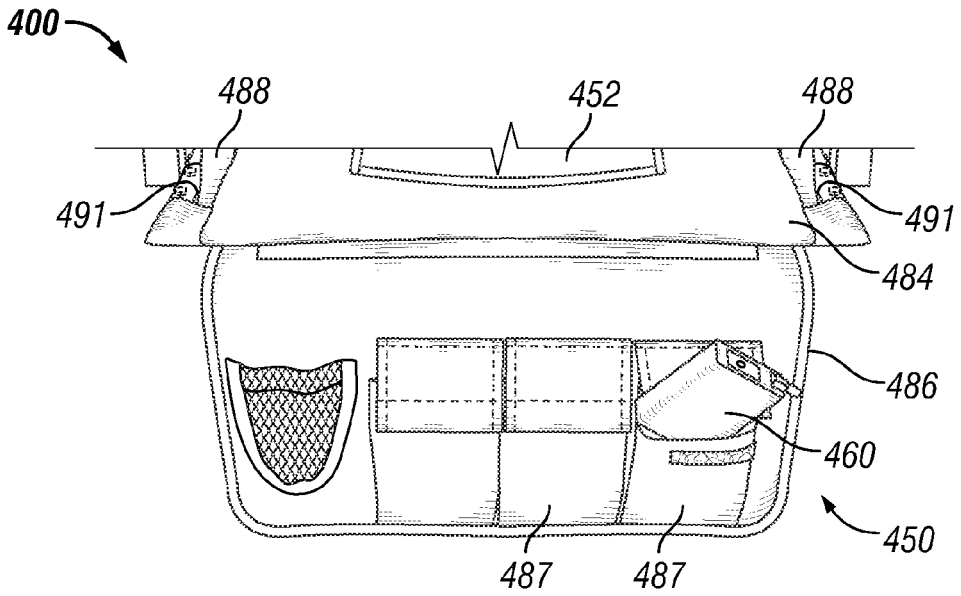
FIG. 32 is a front perspective view of multiple storage compartments of the heated stadium chair of FIG. 27, more particularly illustrating a combined controller/power source for the heating mechanism of the chair.
Figure 33:
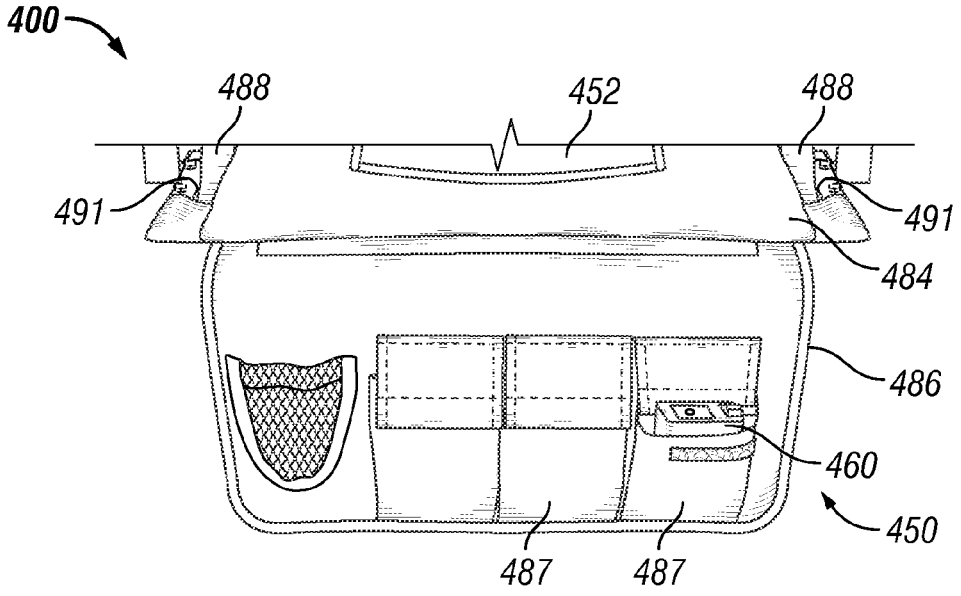
FIG. 33 is an enlarged front perspective view of the storage compartments of the heated stadium chair illustrated in FIG. 32.

In some embodiments, a leg panel 486 may extend downwardly from a front edge of the seat 484. At least one leg panel pouch 487 may be provided on the leg panel 486. In some embodiments, multiple leg panel pouches 487 may be provided on the leg panel 486 in adjacent, spaced-apart relationship to each other, as illustrated. Each leg panel pouch 487 may be stitched and/or otherwise attached to the leg panel 486 according to the knowledge of those skilled in the art. As illustrated in FIGS. 32 and 33, the controller/power source 460 of the heating mechanism 450 may be contained in one of the leg panel pouches 487.

A pair of seat straps 488 may extend between the seat 484 and the backrest 485. In some embodiments, each seat strap 488 may be attached to the backrest frame portion 481 at a corresponding strap opening 490 and to the seat frame portion 482 at a corresponding seat strap opening 491. The seat straps 488 may constrain rearward movement of the backrest 485 with respect to the seat 484 when the heated stadium chair 400 is deployed in the functional position illustrated in FIGS. 30 and 31.

In exemplary application, the heated stadium seat 400 can be deployed on a stadium bench (not illustrated) in a stadium to provide comfortable seating for a user. Accordingly, the heated stadium seat 400 can be deployed from the collapsed configuration illustrated in FIGS. 34-36 to the functional position illustrated in FIGS. 30 and 31 by pivoting the backrest frame portion 481 rearwardly with respect to the seat frame portion 482, with the seat straps 488 extending between the backrest 485 and the seat 484. The backrest frame portion 481 is placed on the stadium bench (not illustrated) and the user sits on the seat 484 and leans against the backrest 485 and rests his or her arms on the respective armrests 483. In cold weather, the user can operate the backrest heating unit 451 and the seat heating unit 452 of the heating mechanism 450 by operation of the controller/power source 460 (FIGS. 32 and 33) to heat the backrest 485 and the seat 484, respectively.

After use, the heated stadium chair 400 can be selectively returned to the collapsed configuration of FIGS. 34-36. As illustrated in FIG. 34, the leg panel 486 can be folded over the backrest 485. In some embodiments, seat securing straps 498, each fitted with a strap buckle 499, may be fastened to secure the heated stadium chair 400 in the collapsed configuration. As illustrated in FIG. 35, in some embodiments, a carrying strap 492 and/or a carrying handle 493 may be provided on the chair frame 402 and/or other structural component of the heated stadium chair 400 for carrying purposes.

Figure 37:
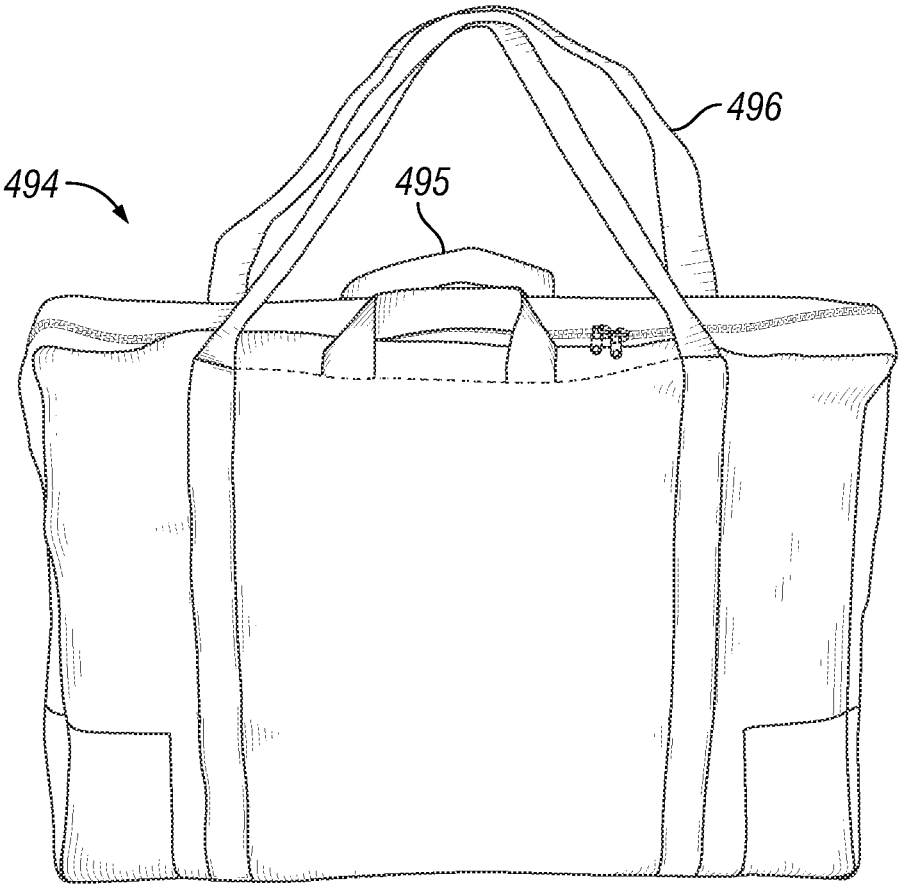
FIG. 37 is a side view of a carrying bag for the heated and double-heated chairs.

As illustrated in FIG. 37, in some embodiments, the collapsed heated stadium chair 400 may be contained and stored or carried in a carrying case 494. The carrying case 494 may be fitted with a carrying case handle 495 and/or a carrying case strap 496 for carrying purposes.

Figure 38:
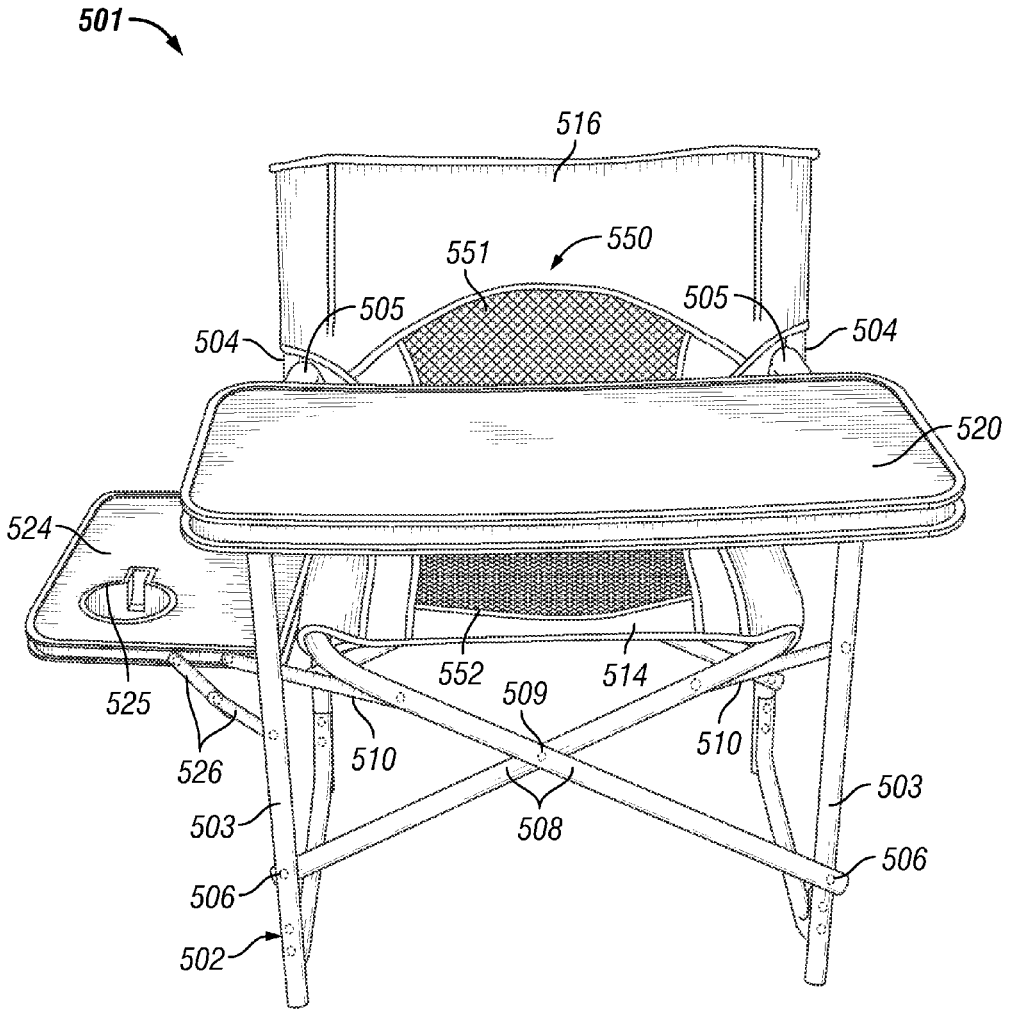
FIG. 38 is a front perspective view of an illustrative embodiment of a heated recreational chair.
Figure 39:
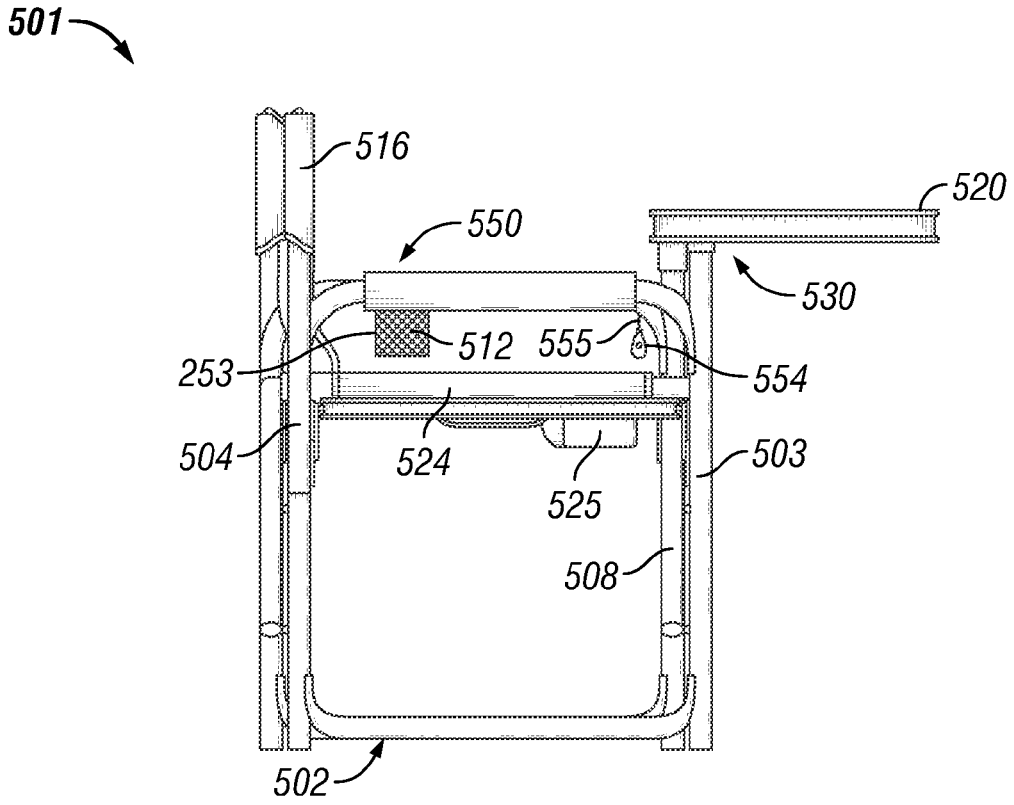
FIG. 39 is a side view of the heated recreational chair illustrated in FIG. 38.

Referring next to FIGS. 38 and 39 of the drawings, an illustrative embodiment of a heated recreational chair is generally indicated by reference numeral 501. The heated recreational chair 501 may have a design which is similar to that of the recreational chair 1 which was heretofore described with respect to FIGS. 1-16. In the heated recreational chair 501 illustrated in FIGS. 38 and 39, elements which are analogous to the respective elements of the heated recreational chair 1 (FIGS. 1-16) are designated by the same numerals in the 500 series. Accordingly, a table top tray 520 may be pivotally connected to the chair frame 502 by a table pivot/swivel mechanism 530 (FIG. 39) which may be similar in design to the pivot/swivel mechanism 130 heretofore described with respect to FIGS. 12-16. A beverage tray 524 may be pivotally attached to the chair frame 502 via at least one tray support arm 526. Therefore, the heated recreational chair 501 may be selectively deployed in the extended, functional position illustrated in FIG. 38 or folded to the collapsed configuration which is illustrated in FIGS. 9A and 9B with respect to the recreational chair 1 for storage and/or transport purposes. In some embodiments, the collapsed heated recreational chair 501 may be placed in a carrying case 70 (FIG. 10) for storage and/or transport purposes.

Figure 22:
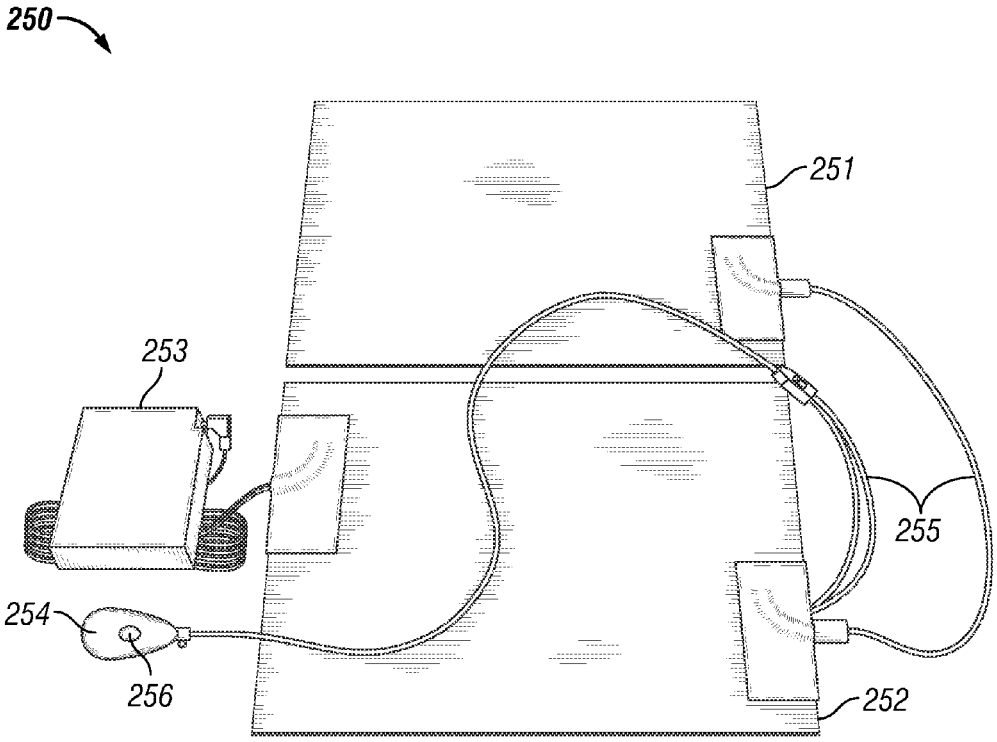
FIG. 22 is a top perspective view of an exemplary heating mechanism of the heated recreational chair of FIG. 17.

A heating mechanism 550 may have a design which is similar to the heating mechanism 250 heretofore described with respect to FIG. 22, with a backrest heating unit 551 provided in or on the backrest 516 and a seat heating unit 552 provided in or on the seat 514; a battery pack 253 connected to the backrest heating unit 551 and the seat heating unit 552; and a control module 554 connected to the battery pack 253, the backrest heating unit 551 and the seat heating unit 552. The control module 554 may include a button 556 which facilitates operation of the backrest heating unit 551 and the seat heating unit 552 at a selected one of multiple heat levels (such as low, medium and high, for example and without limitation).

In exemplary use, the heated recreational chair 501 is deployed in the extended, functional configuration illustrated in FIGS. 38 and 39 to support a user (not illustrated) on the seat 514 and the backrest 516. When the heated recreational chair 501 is used in a cold environment, the control module 554 of the heating mechanism 250 may be operated to heat the backrest heating unit 551 and the seat heating unit 552, which in turn heat the backrest 516 and the seat 514, respectively. The heat level of the backrest heating unit 551 and the seat heating unit 552 may be selected according to the desired comfort level of the user.

When use of the heated recreational chair 501 is not desired, the heated recreational chair 501 can be selectively deployed in the collapsed configuration which is illustrated in FIGS. 9A and 9B with respect to the recreational chair 1 for storage and/or transport purposes. In some applications, the collapsed heated recreational chair 501 may be placed in the carrying case 70 (FIG. 10) for storage and/or transport purposes.

While the invention has been described in connection with a preferred embodiment, it is not intended to limit the scope of the invention to the particular form set forth, but on the contrary, it is intended to cover such alternatives, modifications and equivalents as may be included within the spirit and scope of the invention and defined by this description.

What is claimed is:

1. A double heated recreational chair, comprising:

a pair of single heated recreational chairs integrally attached to each other and having a pair of chair frames including a pair of spaced-apart side frame portions and a central chair frame in common, a pair of backrest frames and a pair of seat frame members carried by the side frame portions and the central chair frame, respectively, a pair of armrests on the pair of spaced-apart side frame portions and a third armrest on the central chair frame;

a seat carried by the seat frame members;

a backrest carried by the backrest frames, the pair of single heated recreational chairs capable of accommodating a pair of users as the users sit on each corresponding seat and against each corresponding backrest of each corresponding single heated recreational chair in an extended, functional configuration of the pair of chair frames;

a pair of independently-operated heating mechanisms enabling selective heating of at least one of the corresponding seat and the corresponding backrest, each of the pair of independently-operated heating mechanisms including at least one of a backrest heating unit carried by the backrest and a seat heating unit carried by the seat, a battery pack electrically connected to the at least one of a backrest heating unit and a seat heating unit and a control module electrically connected to the battery pack and the at least one of a backrest heating unit and a seat heating unit, the control module carried by a corresponding one of the pair of armrests on the pair of spaced-apart side frame portions;

wherein the pair of chair frames is selectively deployable in a folded, collapsed configuration and the extended, functional configuration;

a beverage tray pivotally carried by each of the pair of chair frames; and a battery pack pouch carried by each of the pair of armrests on the pair of spaced-apart side frame portions, the battery pack contained in the battery pack pouch.

2. The double heated recreational chair of claim 1 wherein the seat frame members comprises a pair of generally U-shaped seat frame members pivotally attached to each other and each of the side frame portions.

3. The double heated recreational chair of claim 1 further comprising at least one cup holder in the beverage tray.

4. A double heated recreational chair, comprising:

a pair of single heated recreational chairs integrally attached to each other and having a pair of chair frames including a pair of spaced-apart side frame portions and a central chair frame in common, a pair of backrest frames and a pair of seat frame members carried by the side frame portions and the central chair frame, respectively, a pair of armrests on the pair of spaced-apart side frame portions and a third armrest on the central chair frame;

a seat carried by the seat frame members;

a backrest carried by the backrest frames, the pair of single heated recreational chairs capable of accommodating a pair of users as the users sit on each corresponding seat and against each corresponding backrest of each corresponding single heated recreational chair in an extended, functional configuration of the pair of chair frames;

a pair of independently-operated heating mechanisms enabling selective heating of at least one of the corresponding seat and the corresponding backrest, each of the pair of independently-operated heating mechanisms including at least one of a backrest heating unit carried by the backrest and a seat heating unit carried by the seat, a battery pack electrically connected to the at least one of a backrest heating unit and a seat heating unit and a control module electrically connected to the battery pack and the at least one of a backrest heating unit and a seat heating unit, the control module carried by a corresponding one of the pair of armrests on the pair of spaced-apart side frame portions;

wherein the pair of chair frames is selectively deployable in a folded, collapsed configuration and the extended, functional configuration;

a beverage tray pivotally carried by each of the pair of chair frames; and a battery pack pouch carried by each of the pair of armrests on the pair of spaced-apart side frame portions, the battery pack contained in the battery pack pouch.

5. The heated recreational chair of claim 4 further comprising at least one cup holder in the beverage tray.

6. The heated recreational chair of claim 4 wherein the seat frame members comprises a pair of generally U-shaped seat frame members pivotally attached to each other and each of the side frame portions.

* * * * *